US005767813A

United States Patent [19]

Verma et al.

[11] Patent Number: 5,767,813

[45] Date of Patent: Jun. 16, 1998

[54] EFFICIENT ELECTRICALLY SMALL LOOP ANTENNA WITH A PLANAR BASE ELEMENT

[75] Inventors: Vikram Verma; Nian Jing Yao, both of Palo Alto, Calif.; Quirino Balzano, Plantation, Fla.

[73] Assignee: Raytheon TI Systems, Inc., Lewisville, Tex.

[21] Appl. No.: 419,894

[22] Filed: Apr. 11, 1995

Related U.S. Application Data

[63] Continuation of Ser. No. 68,682, May 27, 1993, Pat. No. 5,485,166.

[51] Int. Cl.[6] ..... H01Q 1/24

[52] U.S. Cl. ..... 343/744; 343/702; 343/741; 343/743; 343/745; 343/748; 343/866; 343/867

[58] Field of Search ..... 343/702, 718, 343/741, 742, 743, 744, 745, 748, 866, 867; H01Q 1/24, 11/12, 7/00

[56] References Cited

U.S. PATENT DOCUMENTS

| | | | |
|---|---|---|---|
| 3,736,591 | 5/1973 | Rennels et al. | 343/702 |
| 3,918,062 | 11/1975 | Haruki et al. | 343/702 |
| 4,491,978 | 1/1985 | Nagata et al. | 455/338 |
| 4,625,212 | 11/1986 | Oda et al. | 343/702 |
| 4,814,776 | 3/1989 | Caci et al. | 343/702 |
| 4,862,181 | 8/1989 | Punce De Leon et al. | 343/702 |
| 4,924,237 | 5/1990 | Honda et al. | 343/702 |
| 4,939,792 | 7/1990 | Urbish et al. | 343/702 X |
| 4,955,084 | 9/1990 | Umetsu et al. | 343/702 X |
| 5,048,118 | 9/1991 | Brook et al. | 343/702 X |
| 5,113,196 | 5/1992 | Ponce De Leon et al. | 343/702 X |
| 5,182,568 | 1/1993 | Stamps, Jr. et al. | 343/702 |
| 5,485,166 | 1/1996 | Verma et al. | 343/744 |

OTHER PUBLICATIONS

Hall et al., *The ARRL Antenna Book*, 1983, pp. 15-6 -15-13.

Ito et al., "A Small Loop Antenna For Pocket-Size VHF Radio Equipment, "National Technical Report (Japan), vol. 19., No. 2, Apr. 1973.

Fujimoto et al., *Small Antennas*, 1987 (no month), pp. 75-117.

*Primary Examiner*—Donald T. Hajec
*Assistant Examiner*—Tan Ho
*Attorney, Agent, or Firm*—Baker & Botts, L.L.P.

[57] ABSTRACT

An efficient electrically small loop antenna includes a radiation device, an impedance matching network, and a connector that interfaces to associated electronic circuitry. The radiation device includes a conductive planar base element extending in a base plane and a conductive loop connected to the planar base element. The loop connects to the base element so that the electrical current for the antenna flows through both the conductive loop and the planar base element. The impedance matching network matches the radiation device to the associated electronic circuitry. The matching network is integrated into the planar base and is connected to both the conductive loop and the base element so that the electric current supplied to the antenna is conducted through both the base element and the conductive loop.

68 Claims, 15 Drawing Sheets

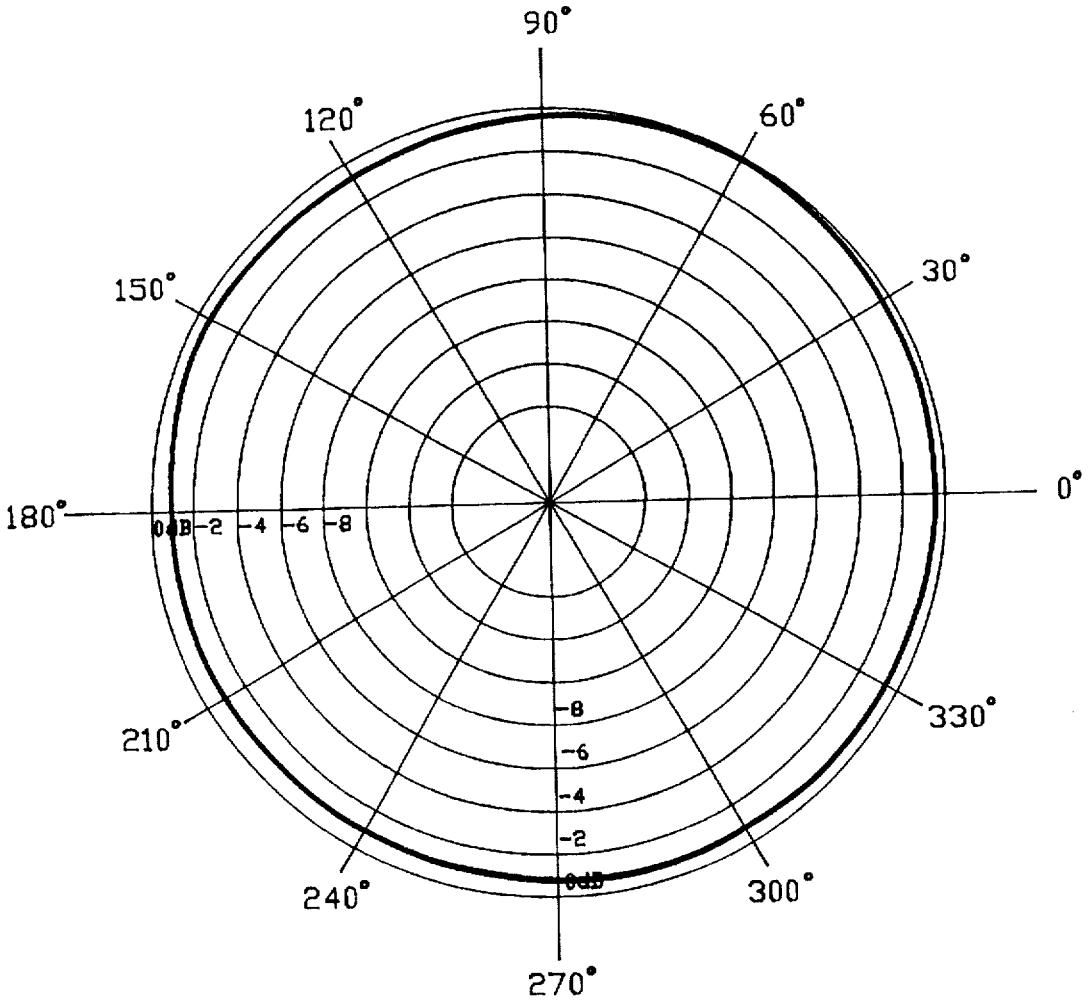
PATTERN NORMALIZED RELATIVE TO THE MAXIMUM GAIN OF 315 MHz ANTENNA
FIG.—5a1
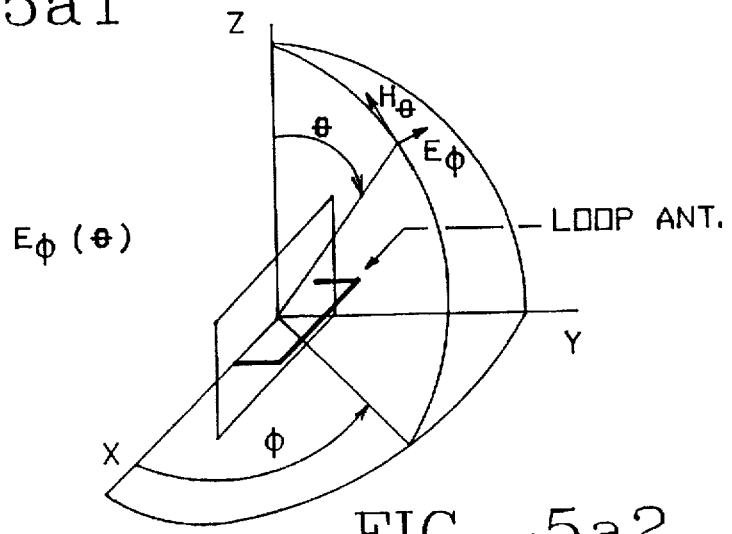
FIG.—5a2

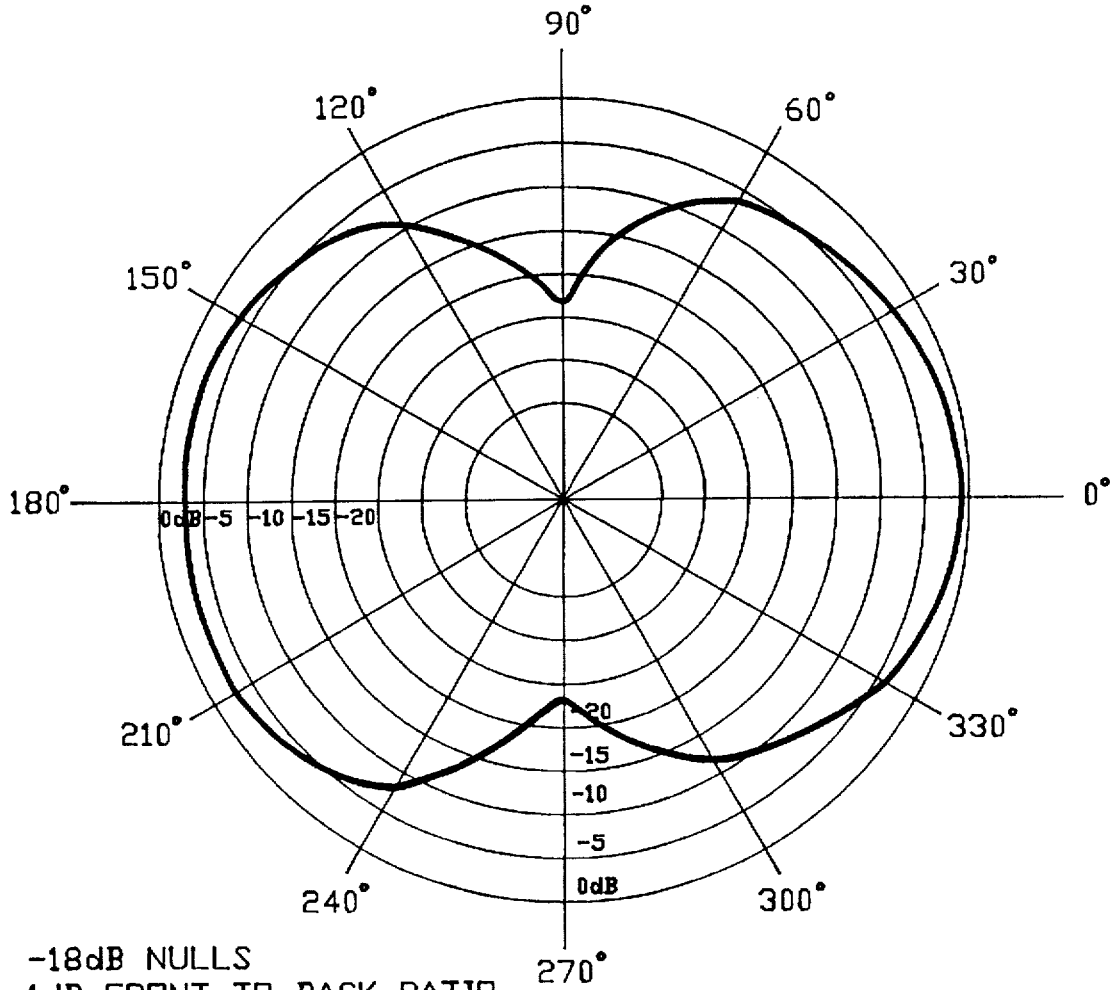
-18dB NULLS
1dB FRONT TO BACK RATIO
PATTERN NORMALIZED RELATIVE TO THE MAXIMUM GAIN (-6.5dBd) OF 315 MHz ANTENNA
FIG.-5b1
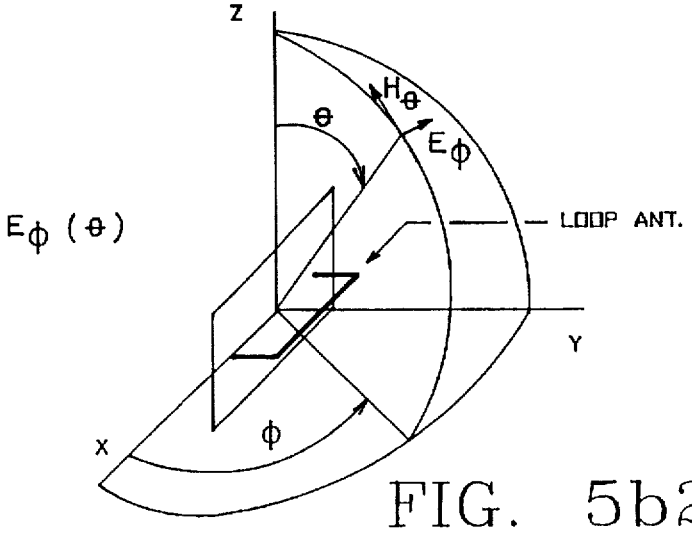
FIG. 5b2

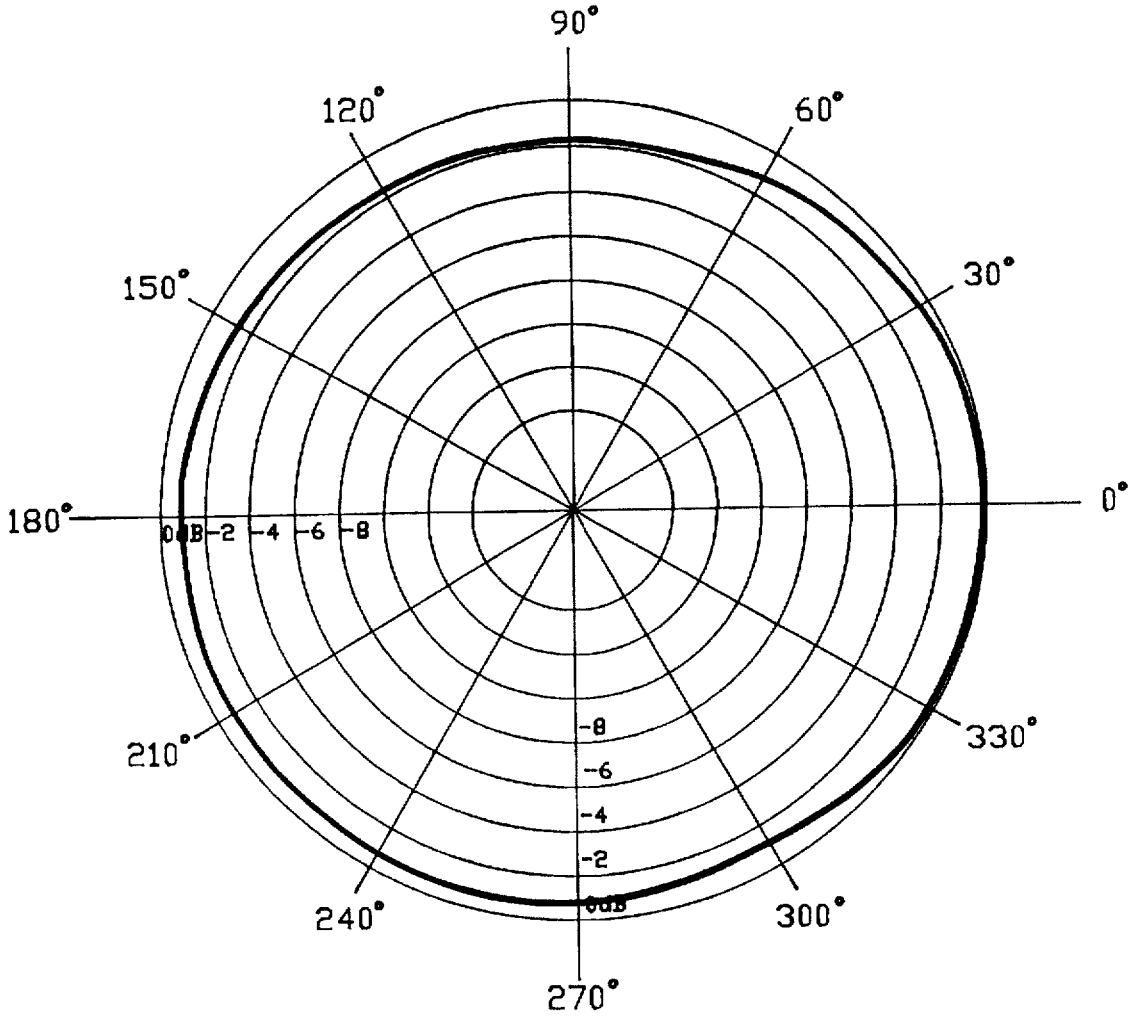
PATTERN NORMALIZED RELATIVE TO THE MAXIMUM GAIN OF 433 MHz ANTENNA
FIG.—8d1
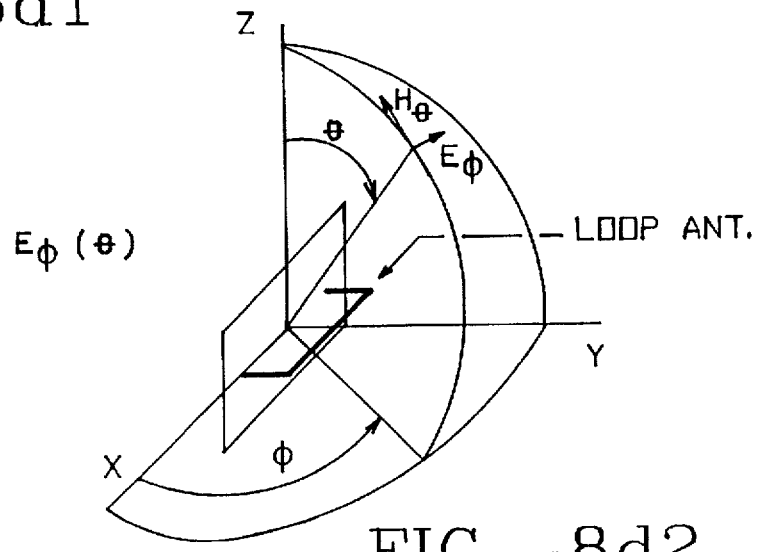
FIG.—8d2

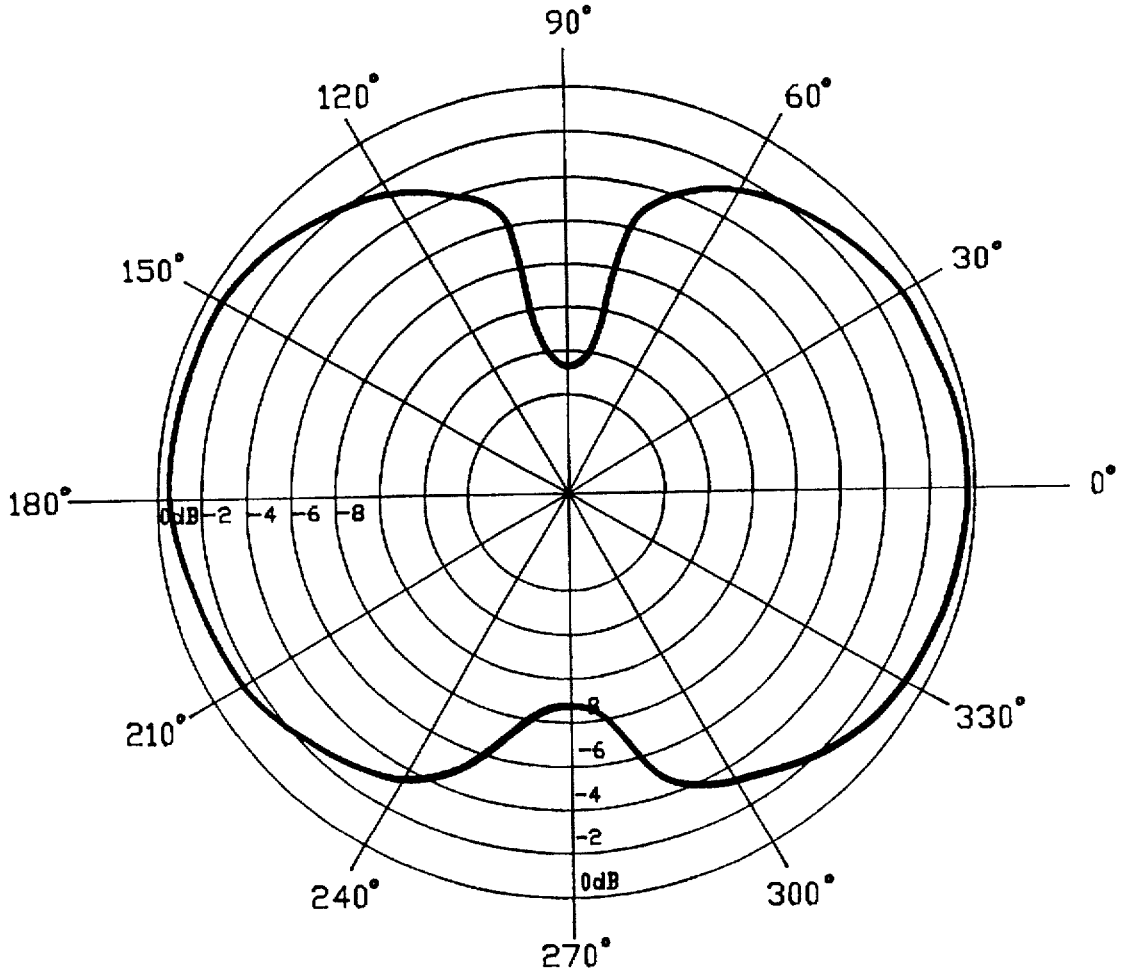
PATTERN NORMALIZED RELATIVE TO THE MAXIMUM GAIN (-3.5dBd) OF 433 MHz ANTENNA
FIG.—8e1
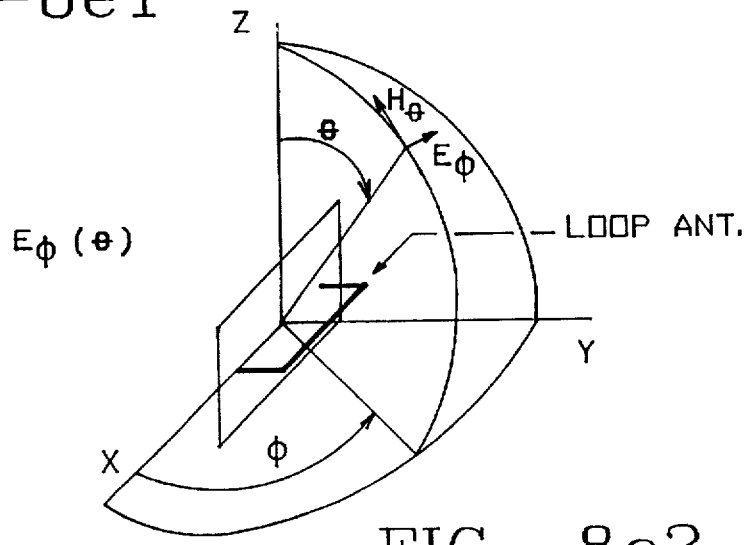
FIG.—8e2

EFFICIENT ELECTRICALLY SMALL LOOP ANTENNA WITH A PLANAR BASE ELEMENT

This application is a continuation of application Ser. No. 08/068,682 filed May 27, 1993 and entitled EFFICIENT ELECTRICALLY SMALL LOOP ANTENNA WITH A PLANAR BASE ELEMENT, now U.S. Pat. No. 5,485,166.

BACKGROUND OF THE INVENTION

This invention relates generally to compact, high-efficiency, electrically small loop antennas for use in both transmitters and receivers of portable communication devices. The physical size of modern compact communication devices (such as radio tags, personal communicators and pagers) is often dictated by the size of the antenna needed to make them function effectively. To avoid devices that are too large, pagers have made use of electrically small rectangular loop antennas as receiving only antennas with the maximum dimension of any antenna elements that constitute the antenna on the order of one-tenth or less of the signal wavelength at the receiving frequency. However, these small antennas tend to be inefficient as a result of their very low radiation resistance and comparatively high loss resistance. Likewise, as a result of their high reactive impedance they tend to be sensitive to their physical environment. These small antennas can cause parasitic oscillations in attached radio frequency (RF) circuitry. Finally, because of their low efficiency, these small antennas are inadequate as transmitting antennas.

To overcome the disadvantages of prior art electrically small loop antennas, there is an outstanding need for antennas small in physical dimension (i.e., each element less than one-tenth of the operating wavelength); having relatively high efficiency; capable of being placed in close proximity to associated electronic circuits without adversely affecting performance; capable of being used effectively for both transmitting and receiving; relatively insensitive to orientation and surroundings; easy to manufacture using standard, low-cost components; and capable of having their radiation pattern altered to support different applications. The antenna described below satisfies all these requirements and is unique in design.

SUMMARY OF THE INVENTION

The present invention is an efficient electrically small loop antenna. The antenna includes a radiation device, an impedance matching network, and a short connector that provides the electrical interface to the associated electronic circuitry. The radiation device includes a conductive planar base element extending in a base plane and a conductive loop connected to the planar base element. The first end of the loop connects to the base element at a first location and the second end of the loop connects to the base element at a second location spaced from said first location so that the electrical current for the antenna flows through both the conductive loop and the planar base element. The impedance matching network matches the radiation device to the associated electronic circuitry. The matching network is integrated into the planar base and is connected to both the conductive loop and the base element at the second location so that the electric current supplied to the antenna is conducted through both the base element and the conductive loop. The connector has first and second conductors for connecting the radiation device and the matching network to the electrical circuit. The first conductor is connected directly to the base element and the second conductor is connected to the matching network so that electrical current is conducted between the associated electronic circuitry and the radiation device. In a low-cost embodiment, the antenna is a rectangular inverted u-shaped loop attached directly to a copper-clad base plate at one end and, through a low-loss impedance matching network, to associated electronic circuitry at the other end. This configuration renders the antenna relatively insensitive to the local physical environment in which it is located and it provides for relatively high radiation efficiency and a radiation pattern similar to that of an ideal small-loop antenna. Because the antenna has relatively high efficiency and provides a stable shield to the associated electronic circuitry placed below the copper base plate, the antenna is ideal for both transmitters and receivers in portable battery-operated devices. Finally, the antenna's relatively small physical size, particularly for UHF and VHF applications, makes it appropriate for use in portable communication devices such as radio tags, personal communicators and pagers.

In summary, the antenna described above includes the following features:

1. Small in size (each element is typically less than one-tenth of the operating wavelength in physical dimension).
2. High electrical efficiency relative to prior art of similar size.
3. Capability of being placed in close proximity to attached electronic RF circuits without affecting performance.
4. Capability of being used effectively for both transmitting and receiving.
5. Performance that is relatively insensitive to orientation and physical surroundings.
6. Manufactured easily using standard low-cost components.
7. Inexpensive, common 2-pin connector that conveniently connects to associated (unbalanced) electronic circuitry on a printed circuit board (PCB) without the use of baluns (balanced to unbalanced transformers).
8. A radiation pattern that is configurable by changing the current flow and distribution on the antenna base element.

The foregoing and other objects, features and advantages of the invention will be apparent from the following detailed description and cited associated drawings.

DESCRIPTION OF THE DRAWINGS

FIG. 2(*b*) shows the antenna impedance matching network geometry on the conducting base element of the antenna of FIG. 1.

FIG. 3(*b*) shows an end view of the FIG. 3(*a*) structure.

FIG. 4(*b*) shows the simplified equivalent circuit for FIG. 4(*a*).

FIG. 5(*a*1) shows the measured radiation pattern of the antenna of FIG. 1 in the X–Y plane.

FIG. 5(*a*2) shows the orientation of the axes for the antenna pattern of FIG. (*a*1).

FIG. 5(*b*1) shows the measured radiation pattern of the antenna of FIG. 1 in the Y–Z plane.

FIG. 5(*b*2) shows the orientation of the axes for the antenna pattern of FIG. 5(*b*1).

FIG. 6(*b*) shows the equivalent circuit of the antenna of FIG. 6(*a*).

FIG. 7(*b*) shows the equivalent circuit of the FIG. 7(*a*) antenna.

FIG. 8(*b*) shows an end view of the antenna of FIG. 8(*a*).

FIG. 8(*c*) shows the equivalent circuit of the FIGS. 8(*a*) and 8(*b*) antenna.

FIG. 8(*d*1) shows the measured radiation pattern of the FIGS. 8(*a*) and 8(*b*) antenna in the X–Y plane.

FIG. 8(*d*2) shows the orientation of the axes for the antenna pattern of FIG. 8(*d*1).

FIG. 8(*e*1) shows the measured radiation pattern of the FIGS. 8(*a*) and 8(*b*) antenna in the Y–Z plane.

FIG. 8(*e*2) shows the orientation of the axes for the antenna pattern of FIG. 8(*e*1).

FIG. 9(*b*) shows a top view of the antenna of FIG. 9(*a*).

FIG. 9(*c*) shows the tapped inductor segment of the matching network of FIG. 9(*a*).

FIG. 9(*d*) shows a bottom view of the antenna of FIG. 9(*a*) and 9(*b*).

FIG. 9(*e*) shows the equivalent circuit of the antenna of FIGS. 9(*a*), 9(*b*) and 9(*d*).

DETAILED DESCRIPTION OF THE DRAWINGS

FIG. 1

Figure 1:
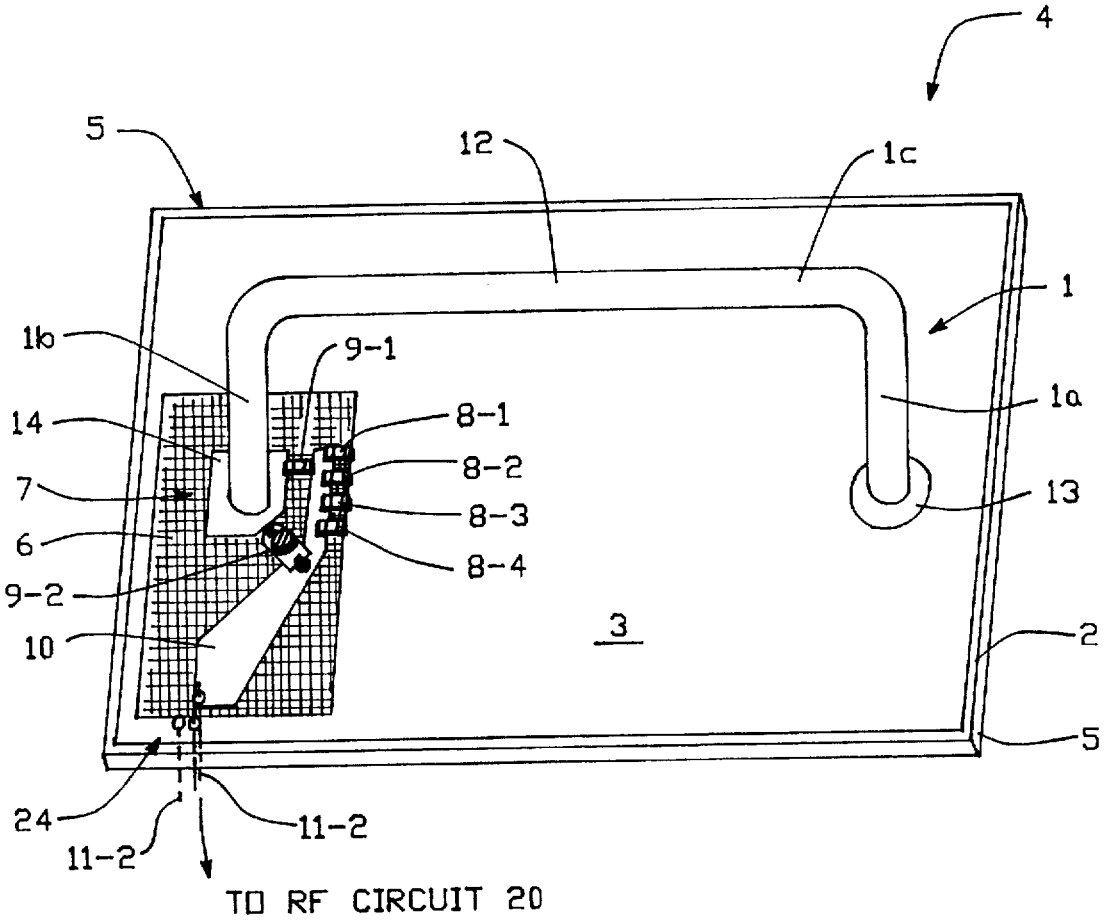
FIG. 1 shows an isometric view of one preferred embodiment of the invention for use at 315 MHz.

FIG. 1 shows an isometric view of one preferred embodiment of a loop antenna 4 of the present invention. The antenna embodiment of FIG. 1 is designed for use at a radiation frequency of 315 MHz. Antenna 4 includes radiator 3 consisting of conducting loop 12 and planar conducting base element 2 on planar non-conducting base 5. Radiator 3 is a radiation device that operates in a transmit mode to transmit radio frequency (RF) signals and operates in a receive mode to receive radio frequency (RF) signals.

In the FIG. 1 embodiment, conducting loop 12 of radiator 3 is formed by three conducting loop elements 1(*a*), 1(*b*) and 1(*c*). The first and second loop elements 1(*a*) and 1(*b*) are legs that are generally perpendicular to the plane of base element 2 while the third loop element 1(*c*) is a leg in an element plane generally parallel to the plane of the base plane of the base element 2. The loop elements 1(*a*), 1(*b*) and 1(*c*) are formed such that the connection between them is a smooth curve. They generally lie in a loop plane perpendicular to the base plane of base element 2.

The approximate size in both physical and electrical dimensions of the antenna loop elements in FIG. 1, for one embodiment, is given below. The wavelength (λ) of the 315 MHz operating radio frequency signal is 952 mm. Base element 2 measures 79 mm (0.08λ) long by 55 mm (0.06λ) wide in the base plane and 0.03 mm (0.00003λ) thick, has perpendicular loop elements 1(*a*) and 1(*b*), each measuring 19 mm (0.02λ) long, and has parallel loop element 1(*c*) measuring 67 mm (0.07λ) long. All of these loop elements in FIG. 1 are significantly shorter in length than one-tenth of a wavelength (0.1λ=95 mm) of the signal at the 315 MHz operating frequency.

The antenna loop elements 1(*a*), 1(*b*) and 1(*c*) are typically circular in cross-section, made of heavy copper wire or tubing and have a diameter of 4.06 mm (0.004λ) in this embodiment. The antenna loop elements 1(*a*) and 1(*b*) are typically attached by connection pads 13 and 14, respectively, to the base 5. Base 5 is fabricated from conventional printed circuit board material with the base element 2 being a 0.03 mm thick copper plate which is clad to a 1.65 mm thick dielectric layer 7. The loop elements 1(*a*), 1(*b*) and 1(*c*) being circular in cross-section have a surface area small compared to the surface area of the planar base element.

The thickness of base element 2 is chosen to be approximately 10 times the depth of penetration (or skin depth) of the current at the operating frequency. At high frequencies, the majority of the current flows on the surface of the conductor. Skin depth is defined as the depth at which the current at a specified frequency has decreased to 36.9% of the magnitude on the surface. A thickness of approximately 10 times the skin depth ensures that the resistive loss of the conductor is minimized by providing a sufficient depth for the current to flow freely. The skin depth at 315 MHz is approximately 0.003 mm.

Dielectric layer 7 is any dielectric material of unspecified loss. Since base element 2, the copper plate layer, is clad to conventional circuit board material, it can be readily etched to form windows and conductors. Specifically, window 6 is etched at one end exposing dielectric layer 7 and leaving strip conductor 10 and connection pad 14 within window 6.

The use of a planar conductor (copper plate on a dielectric layer) for base element 2 (to form the fourth leg of the antenna 4), as shown in FIG. 1, provides at least four significant advantages that improve the performance of the electrically small loop antenna 4.

As a first advantage, base element 2 provides a large cross-sectional area for the electrical current since base element 2 is one of the legs of the antenna 4. This large area results in a low ohmic loss, a loss that is reduced appreciably from the ohmic loss that would occur if base element 2 were a wire conductor like loop element 12. Since base element 2 is one of the longest of the four legs of the antenna 4, reducing the ohmic loss in leg 2 appreciably reduces the ohmic loss for the whole antenna 4.

As a second advantage, base element 2, when grounded by conductor 11-2, serves as a low potential reference point which reduces losses due to the coupling of inductive energy from the antenna 4 to RF circuit components 23 on the circuit board 20 (see FIG. 3) which are in close proximity to the antenna 4. The loss that would occur in the absence of the shielding of the base element 2 would significantly reduce the efficiency of the antenna 4.

As a third advantage, the antenna is relatively insensitive to its surroundings and orientation when it includes a planar conductor such as base element 2. This insensitivity allows the antenna to be used in portable communication devices irrespective of the composition of the objects in the physical environment where the communication devices are located.

As a fourth advantage, the surface of the planar conductor can be readily altered (by etching a different pattern on the printed circuit board) to modify the current flow and thus adjusts and optimizes the radiation pattern to conform to different applications.

The structure of planar base 5 includes window 6 in base element 2 underlying loop element 1(*b*). Window 6 exposes dielectric layer 7 to provide a non-conductive region within the surrounding conductive base element 2. Base element 2 does not contact the loop element 1(*b*) directly. Printed strip connector 10 lies in the window 6 between the connecting pad 14 of the loop element 1(*b*) and the base element 2 without directly contacting either.

To create a capacitive impedance matching network 19, fixed capacitor 9-1 ($C_{s1}$) and tunable capacitor 9-2 ($C_{s2}$) are connected between the strip connector 10 and the connecting pad 14. Pad 14 is electrically connected to the end of the loop element 1(*b*). Capacitors 9-1 and 9-2 are electrically connected in series with radiator 3. Radiator 3 is formed of four elements including loop elements 1(*a*), 1(*b*), and 1(*c*) and base element 2. Impedance matching capacitors 8-1, 8-2, 8-3 and 8-4 ($C_{p1}$, $C_{p2}$, $C_{p3}$ and $C_{p4}$, respectively) are connected across window 6 between strip connector 10 and base element 2. They are electrically connected in parallel to the series connection of radiator 3 and capacitors 9.

Strip connector 10 combined with the series resonant capacitors 9 and parallel matching capacitors 8 constitute the capacitive impedance matching network 19 within window 6. This connector matches antenna 4 to a 50 ohm input port of an RF circuit on circuit board 20.

In order to achieve a low-cost and easily manufactured antenna, all capacitors, including the tunable capacitor $C_{s2}$, can be standard, inexpensive and low-frequency capacitors constructed from nominally high-loss dielectric material. The term "high-loss" dielectric material means that which exhibits high loss at high frequencies. Although such capacitors are rarely used at high frequencies because of their relatively high-loss characteristics at those frequencies, they provide good performance in the present invention when low cost is important. Also, base 5 may be low-cost printed circuit board material with a relatively high-loss dielectric layer (for example, standard FR-4 printed circuit board material). For even better performance, low-loss dielectric materials can be employed. The term "low-loss" dielectric material means that which exhibits low loss at high frequency. For example, high-frequency PTFE (commonly known as Teflon fluropolymer®) woven-glass laminate with one-sided, 1 oz. (0.03 mm) copper cladding can be used for base 5. Additionally, high-frequency, low-loss microwave capacitors can be used to obtain higher performance for the antenna. Components that use such low-loss dielectric materials moderately increase the efficiency of the antenna at a cost increase of about 8 to 10 times that of components which use high-loss materials.

Circuit boards and capacitors have loss characteristics that are measured by equivalent series resistance (ESR). At VHF and UHF frequencies when inexpensive dielectric materials are used in antennas, as in the present invention, the total ESR loss compared to the radiation resistance of the antenna is a significant factor. ESR losses significantly reduce antenna efficiency. The present invention, through the appropriate selection of capacitor values as well as the optimized etching pattern design of the base element, reduces the antenna resistive losses that otherwise would be significant at these frequencies for this kind of antenna.

Figure 2A:
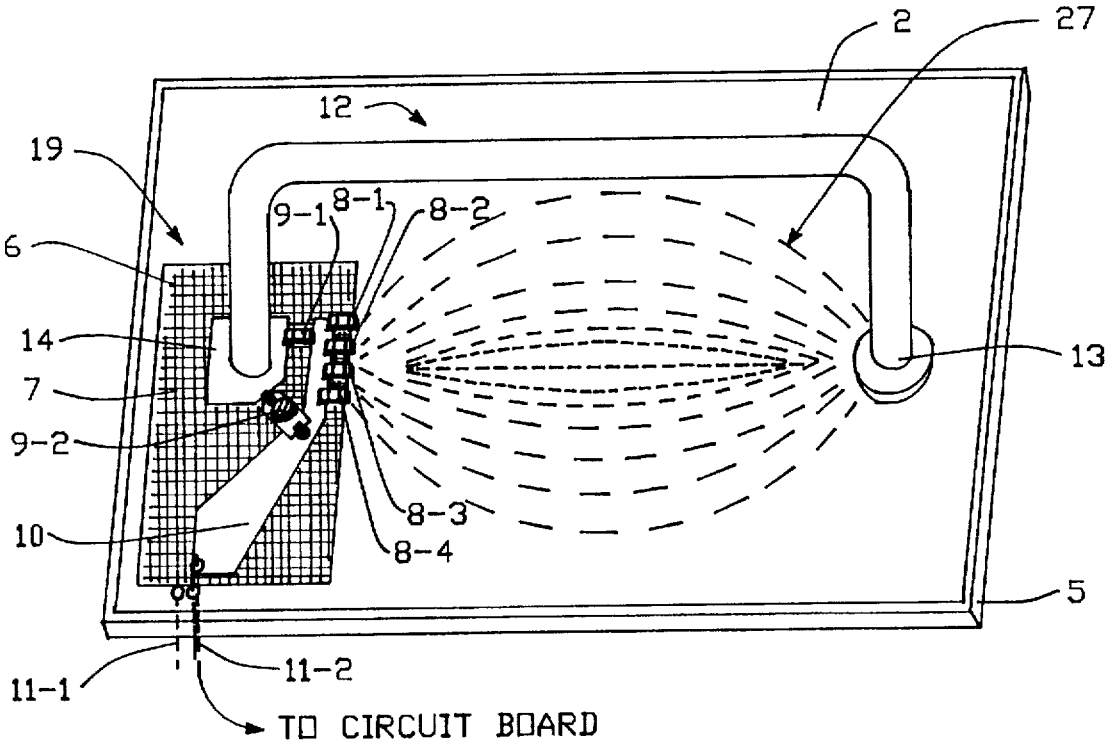
FIG. 2(*a*) shows the current distribution in the conducting planar base element that forms one leg of antenna of FIG. 1.
Figure 2B:
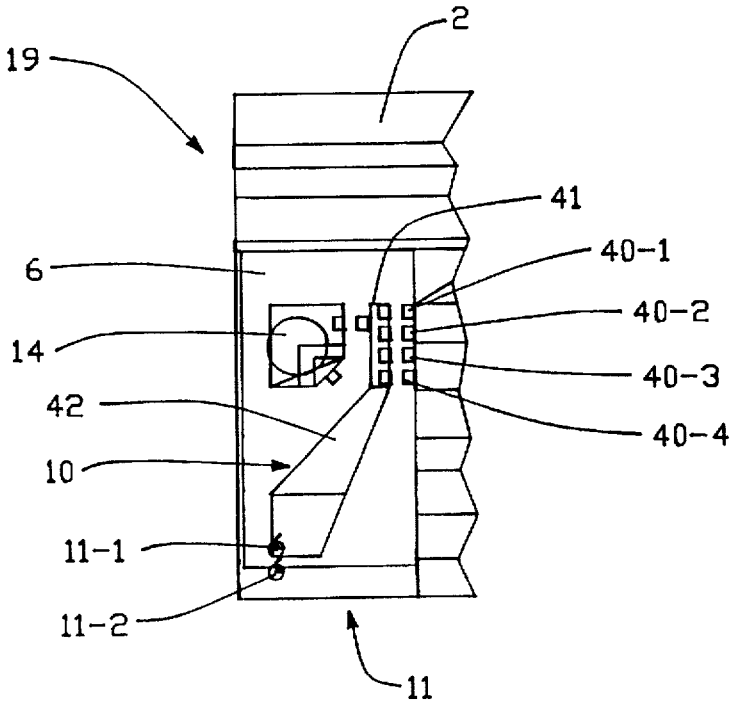

In one embodiment, a low-cost FR-4 material is used for dielectric layer 7 of the base 5. The board losses due to the FR-4 material are minimized by selecting a geometry that minimizes the stray capacitance around the high voltage potential difference areas that are associated with the antenna currents. This minimization is achieved by positioning traces, pads, strip conductor, and other conductive components in the high voltage potential difference regions such that the distance between high and low potential points is maximized and consequently the stray displacement current is minimized. In FIG. 2(*b*), the geometry of the antenna matching network 19 in the high potential gradient area of the antenna is such that components are spaced apart to minimize stray current.

In order to increase the efficiency of antenna 4, the height of loop elements 1(*a*) and 1(*b*), relative to the size of base element 2, is optimized. For a given size of base element 2, an increase in the height of loop elements 1(*a*) and 1(*b*) initially increases efficiency toward a peak value. Further height increases after the peak value result in a decrease in efficiency. The initial increase in efficiency results from the increase in radiation resistance due to the increasing loop area, but this efficiency increase is then offset by the decrease in efficiency due to the decrease in the effective shielding provided by base element 2 that results at greater loop element height. The decrease in shielding results in increased proximity losses which eventually offset the increase in radiation resistance due to the increasing loop area. In this particular embodiment, the total base element width was at least three times the height of the highest antenna elements when the antenna element was positioned at the center of the base element.

Figure 3A:
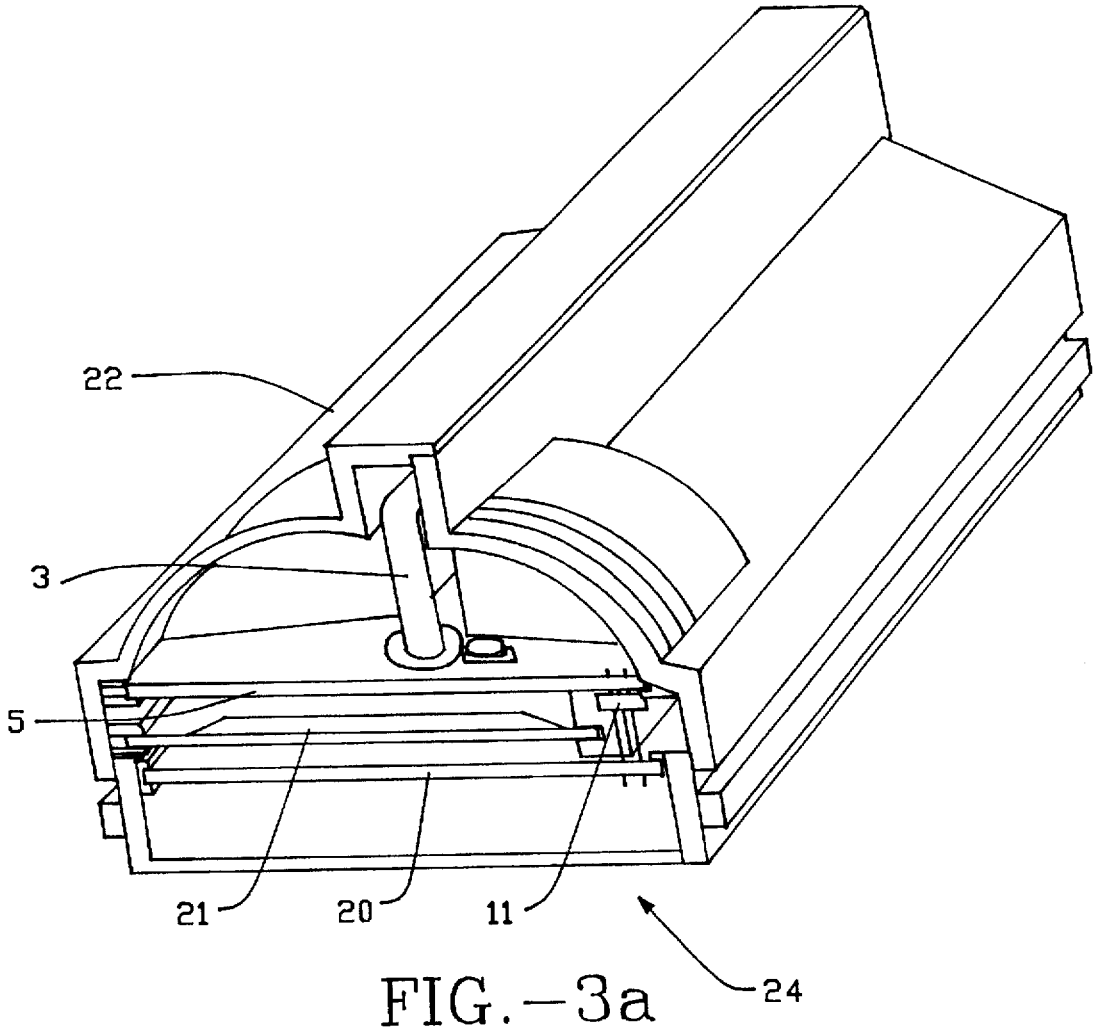
FIG. 3(*a*) shows an isometric view of the antenna and connected circuit board and battery, all within a tag casing.
Figure 3B:
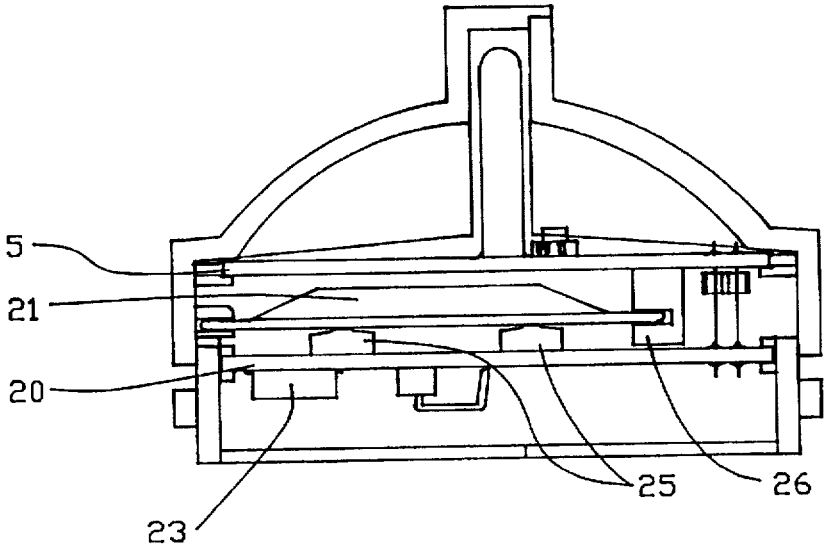

In order to connect antenna 4 to the antenna circuit components 23 on attached circuit board 20 (see FIG. 3(*b*)), the strip connector 10 and base element 2 are electrically connected to a short connector 11. Connector 11 includes signal-line conductor 11-1 which connects to the strip connector 10 which, in turn, connects through the series resonant capacitors 9-1 and 9-2 ($C_{s1}$ and $C_{s2}$) to one end of the conductive loop 12 at loop element 1(*b*) (See FIG. 2(*a*)). Connector 11 also includes signal-return conductor 11-2 that connects directly to base element 2, and permits low-loss conduction through base element 2 to the other end of conductive loop 12 at loop element 1(*a*). The parallel matching capacitors 8-1, 8-2, 8-3 and 8-4 ($C_{p1}$, $C_{p2}$, $C_{p3}$ and $C_{p4}$) complete the resonant antenna circuit by connecting base element 2 to strip connector 10.

In the FIG. 1 embodiment, conducting base element 2 forms one leg of the loop antenna 4 so that the electrical current that conducts in conductive loop 12 and loop elements 1(*a*), 1(*b*) and 1(*c*) also conducts through base element 2. The dimensions of base element 2 in the base plane (generally perpendicular to the loop plane of loop conductors 1(*a*), 1(*b*) and 1(*c*)) are large relative to the geometric projection of the loop conductors onto the base plane. With this relationship, the pattern of current in base element 2 tends to conduct outside the loop plane. Also, with this relationship, base element 2 acts as a shield between radiator 3 and the attached circuit components 23 on attached circuit board 20 (see FIG. 3(*b*)).

FIG. 2

In FIG. 2(*a*), the current distribution in conducting base element 2 is shown as broken lines. The current 27 is distributed in the manner shown because base element 2 is a planar conductor formed of a conductive sheet material, copper in this case. A substantial portion of the current 27 is outside of the plane of loop element 12 where the loop plane is normal to the plane of base element 2. The significance of the distribution of current 27 in FIG. 2(*a*) is that the current density at any particular spot on base element 2 is lower than if base element 2 were a wire or tube like loop element 12. This lower current density, coupled with the substantially lower resistance and reactance of the planar base element (compared to that provided by a circular tube), results in much lower losses than would have occurred if base element 2 was not planar.

In the antenna of FIG. 1, the effects of the dielectric material are minimized with conductor geometries that minimize the stray capacitance particularly around the high potential gradient regions. The high potential gradient regions that are most critical are those in the resonant electrical current path, that is, the loop element 12, base element 2, capacitors 8 and capacitors 9. The resonant electrical current path conducts resonant current through loop 12 and base element 2 and is Q times higher than the external electrical current through connector 11 where Q is the antenna quality factor that exceeds 100 in the FIG. 1 embodiment.

The resonant circuit path that conducts the high resonant current includes conductive loop 12, base element 2, parallel matching capacitors 8 and series resonant capacitors 9. In the FIG. 1 antenna, these elements are located with a geometry on planar base 5 that provides a minimum length for the resonant current path. This minimum length is achieved by having the components lie close to the loop plane of conductive loop 12. Specifically, capacitors 8 and 9 lie close to the projection of loop 12 onto the base plane of base element 2.

The ESR loss of a capacitor is proportional to the square of the current times the ESR of the capacitor, and the ESR of the capacitor is relatively independent of the capacitor value within certain ranges; therefore, spreading the current over multiple capacitors with comparable ESR's significantly reduces the loss. This concept is utilized in the design of parallel matching capacitors 8. By using four equal capacitors, 8-1, 8-2, 8-3 and 8-4, the current in each capacitor is one-quarter of what would occur if a single capacitor were used. Furthermore, the current density of base element 2 is reduced in the region where the capacitors 8 are connected by spacing the four capacitors apart; the spacing of capacitors 8 spreads the current in base element 2 over the area occupied by the connections of the four capacitors. Thus a balance is made between spreading the capacitors from each other to reduce current density and crowding the capacitors toward the plane of loop 12 to reduce the path length.

FIG. 2(*b*) shows the geometry of the antenna matching circuit conductors in the window 6 region in greater detail. The conductors include traces 40-1, 40-2, 40-3 and 40-4 for mounting capacitors $C_{p1}$, $C_{p2}$, $C_{p3}$ and $C_{p4}$, respectively. Strip connector 10 has a narrow end 41 for connections in the internal resonant circuit path and broadens to a wide end 42 (that is longer than narrow end 41) for connection to external connector 11. Strip connector 10 is located in the center of window 6 away from the edges of base element 2 so as to minimize stray capacitance between strip connector 10 and base element 2.

In FIG. 2(*b*), the size, shape and location of window 6, strip conductor 10, contact pad 14 and capacitors 8 and 9 were all chosen to reduce losses. Particularly, the short path from base element 2, through capacitors 8, to narrow end 41 of strip conductor 10, through capacitors 9, to connection pad 14 is in a straight line. This arrangement is necessary in order to make the path as short as possible since this path carries the resonant current which is Q times the electrical current flowing through connector 11 via terminals 11-1 and 11-2. The path length from the narrow end 41 to the wide end 42 of strip connector 10 is somewhat longer than desired but was selected to position connector 11 at a location that is convenient for connection to circuit board 20 (see FIG. 3(*a*)). Although connector 11 (including connectors 11-1 and 11-2) can be placed close to the plane of loop 12 for improved performance, the placement of connector 11 (and hence the length and location of strip connector 10) is of somewhat less concern since the current in strip connector 10 is 1/Q of the current in the resonant path.

FIG. 3(*a*)and 3(*b*)

FIG. 3(*a*), shows an isometric view of the antenna 4 of FIG. 1 where antenna 4 is connected to electronic circuit board 20 within the case 22. Planar base 5 is connected on one end to two-wire connector 11 (including signal conductor 11-1 and ground conductor 11-2) which in turn is connected to printed circuit board 20. Antenna 4 and circuit board 20 are connected by connector 11 at one corner 24 of base 5 to permit an opening through the end of case 22 for insertion and withdrawal of battery 21. FIG. 3(*b*) shows an end view of the antenna and the circuit board of FIG. 3(*a*).

The configuration of FIG. 3, with a copper plate for base element 2 of antenna 4, provides a conductive plane for the electronics on the circuit board 20 as shown in FIG. 3(*b*), with one end grounded by connector 11-2. When base element 2 acts as a conductive plane, the subsequent shielding effect allows sensitive electronic circuitry 23 on circuit board 20 to operate in a stable manner although it is situated close to antenna 4. FIG. 3 shows a preferred connection and orientation of antenna 4 and circuit board 20. The attachment of connector 11 at a corner 24 between antenna 4 and circuit board 20 allows a removable flat battery 21 to fit between the antenna 4 and the circuit board 20, thereby providing a compact and integrated assembly. Battery 21 provides further shielding to electronic components 23 on circuit board 20 from antenna 4 and this shielding, combined with the other shielding provided by base element 2, is highly effective in isolating antenna 4 from electronic circuitry 23 on circuit board 20.

The case 22 includes slots or other means for engaging the circuit board 20 at a first level, means for engaging the battery 21 at a second level parallel to the first level, means for engaging the radiation device at a third level parallel to the first level whereby the base element of the antenna and the battery are positioned between the radiation device and the electrical circuit to shield the electrical circuit from the radiation device (antenna 4).

FIG. 4

Figure 4A:
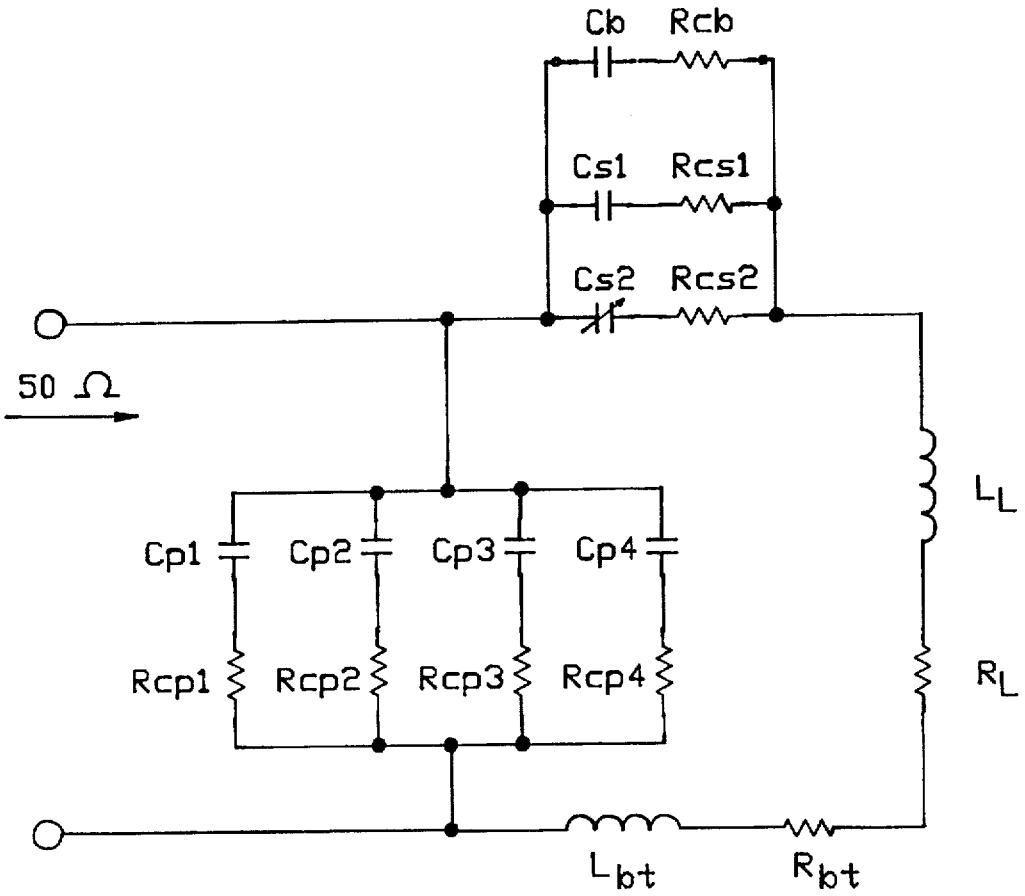
FIG. 4(*a*) shows the equivalent circuit of the antenna of FIG. 1.
Figure 4B:
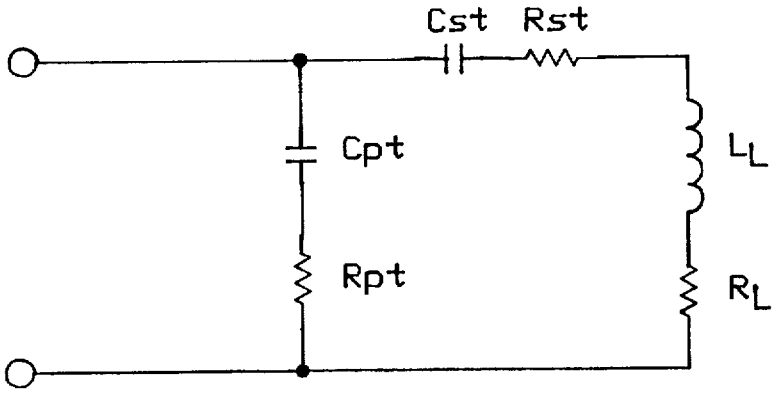

The equivalent circuit for the antenna of FIG. 1 is shown in FIG. 4(*a*). The equivalent circuit of FIG. 4(*a*) is like that of a typical electrically small loop antenna that utilizes a capacitive matching circuit; therefore, FIG. 4(*a*) can be simplified to the FIG. 4(*b*) typical small loop antenna representation. Both the FIG. 4(*a*) and the FIG. 4(*b*) equivalent circuits recognize that at UHF and VHF frequencies, capacitors have an appreciable resistive component (equivalent series resistance, or ESR) resulting from the losses of the dielectric material and leads. The ESR for a capacitor value within certain ranges is relatively independent of the capacitor value. The components of FIGS. 4(*a*) and 4(*b*) are defined in the following TABLE-FIG. 4.

TABLE-FIG. 4

$L_{bf}$=Total inductance of the base element.
$R_{bf}$=Total resistance of the base element.

$L_L$=Antenna loop inductance.

$R_L$=Antenna loop radiation resistance and ohmic loss resistance.

$C_b$=Stray capacitance from board dielectric.

$R_{cb}$=ESR of $C_b$.

$C_{s2}$=Series resonant capacitance (Variable capacitor 2–6 pF).

$R_{cs2}$=ESR of $C_{s2}$.

$C_{s1}$=Series resonant capacitance (Bias capacitor for easy tuning).

$R_{cs1}$=ESR of $C_{s1}$.

$C_{st}$=Total series resonant capacitance.

$R_{st}$=Total ESR of $C_{st}$.

$C_{pi}$=Impedance matching capacitance where, for i=1, 2, 3 and 4, $C_{pi}$ has values $C_{p1}$, $C_{p2}$, $C_{p3}$, and $C_{p4}$.

$R_{cpi}$=ESR of $C_{cpi}$ where for i=1, 2, 3 and 4, $R_{cpi}$ has values $R_{cp1}$, $R_{cp2}$, $R_{cp3}$, and $R_{cp4}$.

$C_{pt}$=Total capacitance of all $C_{pi}$.

$R_{pt}$=Total ESR of all $R_{cpi}$.

As previously discussed, stray currents resulting in losses reside in the dielectric material of base 5. Furthermore, capacitors 8 and 9 have losses associated with them. The equivalent circuit shown in FIG. 4(*a*) accounts for these losses that cause antenna 4 to have a non-ideal behavior. Each capacitor in FIG. 4(*a*) has an associated ESR and the board loss resistance and stray capacitance of base 5 are represented by $R_{cb}$ and $C_b$, respectively. In order to further increase the efficiency of antenna 4, the dielectric losses due to the non-ideal capacitor characteristics as well as the stray losses due to the dielectric material must be reduced. These reductions result in part from the advantageous placement of series resonant capacitors 9 and parallel matching capacitors 8. Furthermore, the losses in strip connector 10 attached to antenna connector 11 are minimized by insuring that the resonant current is not conducted through the full length of strip conductor 10 but primarily through the narrow end 41. The dielectric losses due to the non-ideal characteristics of capacitors 8 are minimized by using several capacitors placed in parallel that together provide the fully designed total capacitance value $C_{pt}$. The equivalent total ESR, $R_{pt}$, is also reduced since the parallel combination of resistance is smaller than any of the combined resistances. Of the series capacitors 9, variable capacitor 9-2 ($C_{s2}$), tends to have a higher $ESR_2$ than $ESR_1$ of fixed capacitor 9-1 ($C_{s1}$). Since $C_{s1}$ and $C_{s2}$ are also placed in parallel, the equivalent series resistance, $ESR_e$, of the parallel combination is less than $ESR_1$, or $ESR_2$ alone. In addition, to facilitate the tuning of the high Q antenna, the value of the $C_{s1}$ capacitor is selected in conjunction with tuning characteristics of capacitor $C_{s2}$. The tuning characteristics of capacitor $C_{s2}$ are represented by $dC/d\psi$ for $C_{s2}$, where $\psi$ is the angle of rotation of the rotating tuning element for capacitor $C_{s2}$ and $dC/d\psi$ is the rate of change of the capacitance, C, of capacitor $C_{s2}$ as a function of $\psi$. A desired tuning characteristic of capacitor $C_{s2}$ is that a large change in $\psi$, that is, a large rotation of the tuning element for capacitor $C_{s2}$, results in a small change in C. This is achieved by selecting $C_{s1}$ such that $dC/d\psi$ tends to a minimum value at the $C_{s2}$ value required to achieve resonance.

FIG. 5

The measured far-field radiation pattern for the embodiment of FIG. 1 is shown in FIG. 5. FIG. 5(*a*1) is the radiation pattern in the X–Y plane expressed as $E_\phi(\phi)$, in polar coordinates. $E_\phi$ is the polarization orientation of the electric field strength where $\phi$ is the azimuthal angle and $E_\phi(\phi)$ expresses $E_\phi$ as a function of the azimuthal angle $\phi$. The pattern is virtually omni-directional which is similar to the radiation pattern of an ideal electrically small loop antenna. The maximum directive gain of the antenna was approximately −6.5 dB with reference to the gain of a dipole antenna (dBd) at the 315 MHz radiation frequency. FIG. 5(*a*1) shows the far-field radiation pattern as normalized to the maximum directive gain of the antenna.

FIG. 5(*b*1) is the measured far-field pattern in the Y–Z plane expressed as $E\phi(\theta)$ in polar coordinates. $E\phi(\theta)$ expresses $E\phi$ as a function of the angle $\theta$, the zenith (elevation) angle. FIG. 5(*b*1) shows the far-field radiation pattern as normalized to the maximum directive gain of the antenna that occurs in the X–Y plane. FIG. 5(*b*1) is a figure-eight pattern similar to the pattern of a ideal electrically small loop antenna. However, because of planar base element 2 the nulls of the FIG. 5(*b*) pattern are somewhat shallower than that of an ideal small loop antenna. Nulls exist at $\theta$=90 and 270 and tend to be approximately 18 to 20 dB below the maximum directive gain of the antenna. There is also a slight front-to-back ratio of 1 dB in this pattern.

FIG. 6

Figure 6A:
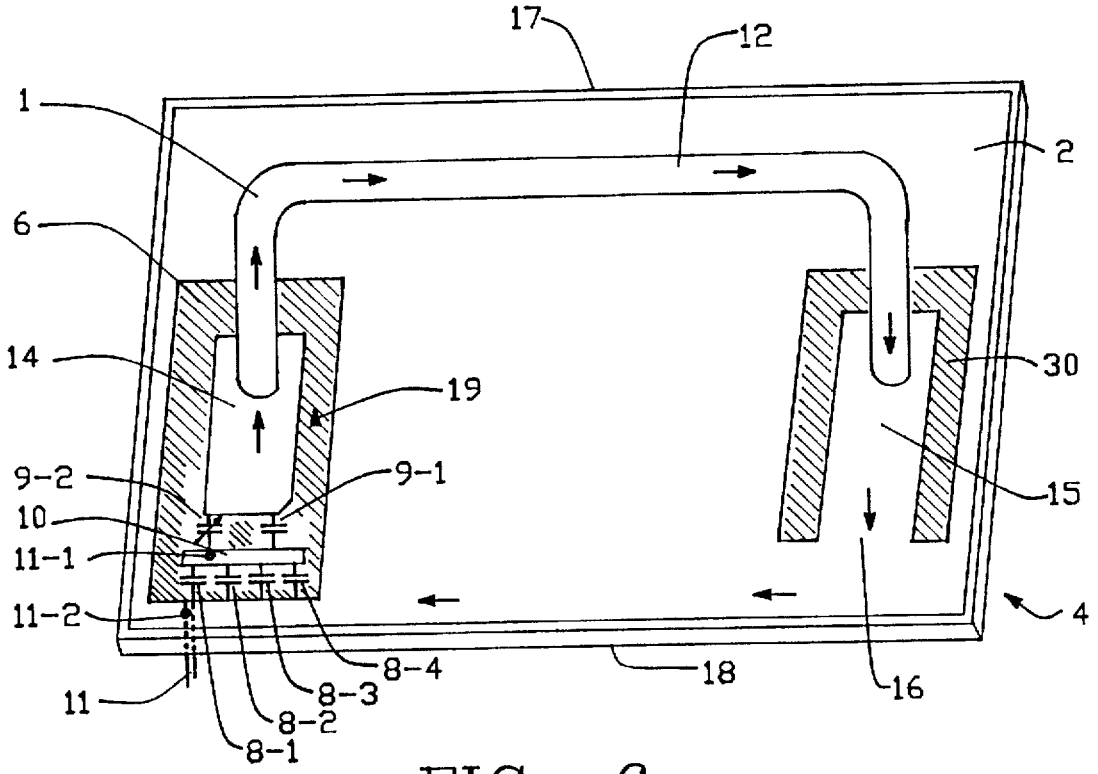
FIG. 6(*a*) shows an isometric view of an alternative antenna embodiment with a virtually omni-directional radiation pattern in both planes.
Figure 6B:
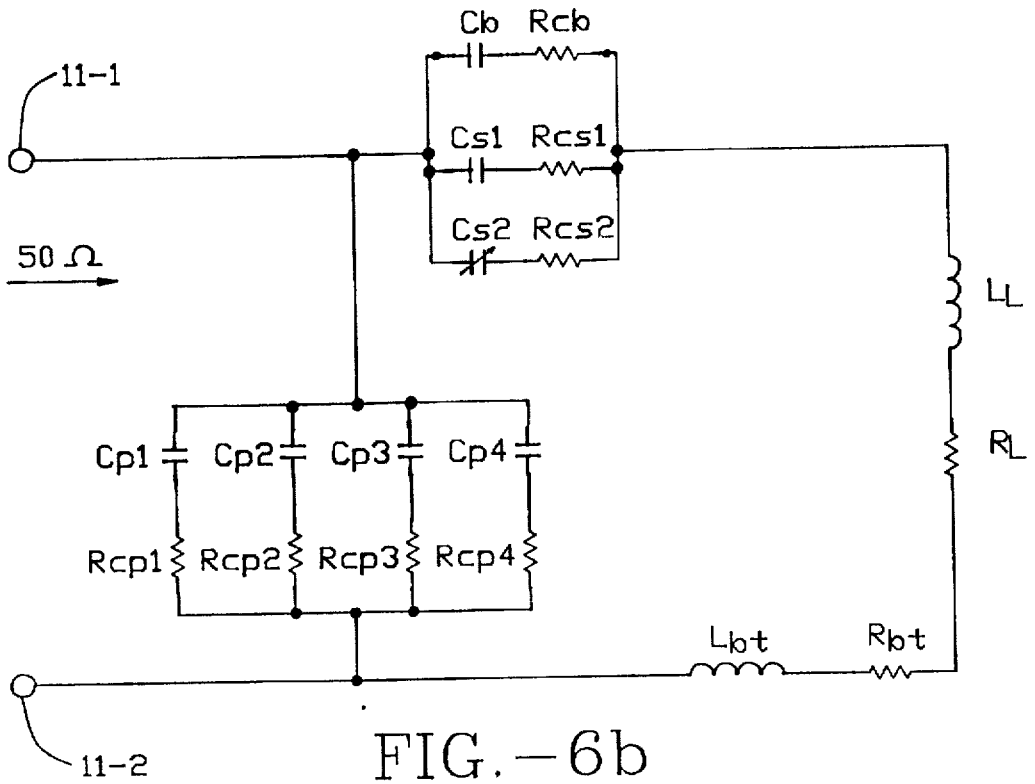

FIG. 6(*a*) shows an isometric view of an alternative embodiment of antenna 4 with a virtually omni-directional far-field radiation pattern in both the X–Y and Y–Z plane. In the FIG. 6(*a*) embodiment, the radiation pattern is altered significantly from the FIG. 1 embodiment by altering the placement of the matching circuit capacitors 8 and 9. In matching network 19, fixed capacitor 9-1 ($C_{s1}$) and variable capacitor 9-2 ($C_{s2}$) connect between strip connector 10 and base pad 14 of loop element 1(*b*), and impedance matching parallel capacitors 8-1, 8-2, 8-3 and 8-4 ($C_{p1}$, $C_{p2}$, $C_{p3}$ and $C_{p4}$, respectively) connect between strip connector 10 and base element 2.

In FIG. 6(*a*) strip pad 15 is connected at one end 16 to base conductor 2. A window 30 of dielectric material (like window 6) surrounds strip pad 15 so that the current through loop 12 is conducted along strip pad 15 to base 2 through end 16. End 16 is on one side of the plane of loop 12. Particularly, loop 12 lies in a plane that is normal to the plane of base element 2. One edge 17 of base element 2 lies on one side of the plane of loop 12 and another edge 18 of base element 2 lies on the opposite side of the plane of loop 12. Accordingly, the current through loop 12 and strip pad 15 tends to be conducted through base element 2 on the side of the plane of loop 12 closest to edge 18 of base 2. Similarly, because capacitors 8-1, 8-2, 8-3 and 8-4 also connect to base element 2 near edge 18, the current from strip pad 15 through base element 2 remains on the side of the plane of loop 12 near edge 18 of base element 2. As a result, the current distribution in base element 2 tends to be unbalanced toward one side of the plane of loop 12, namely toward the side of edge 18.

Because of the orientation of strip pad 15, window 30 and the matching circuit components (including pad 14, capacitors 9, strip connector 10 and capacitors 8), the conduction path length for the current in the resonant circuit path is somewhat longer in the FIG. 6(*a*) embodiment than in the FIG. 1 embodiment. Since the path is somewhat longer, the efficiency of the antenna (and hence maximum directive gain) of FIG. 6(*a*) is somewhat less. However, in exchange for the lower efficiency the antenna of FIG. 6(*a*) is more omni-directional than the antenna of FIG. 1. Also, it should be noted that the directionality of the antenna is readily controlled by merely changing the printed pattern of base element 2 and the associated pads, connectors and windows of base 5. Since these geometries are readily changed using well-known printed circuit technology, antenna design parameters for gain and directionality are easily modified.

The configuration in FIG. 6 provides a more omnidirectional pattern at the expense of reduction in efficiency of the antenna.

The equivalent circuit of the embodiment of FIG. 6(*a*), as seen in FIG. 6(*b*), is identical to that of the antenna shown in FIG. 1; however, in this embodiment, the series components $L_{bt}$ and $R_{bt}$ are equivalent to the sum of the contributions of strip pad 15 ($L_{b1}$), pad 14 ($L_{b2}$) and base element 2 ($L_{b3}$), and the sum of their ohmic loss resistances, respectively. The components in FIGS. 6 have the definitions set forth in TABLE-FIG. 4 and in the following TABLE-FIG. 6.

TABLE-FIG. 6

$L_{b1}$=Inductance of the right strip.
$R_{b1}$=Ohmic loss resistance of $L_{b1}$.
$L_{b2}$=Inductance of the left strip.
$R_{b2}$=Ohmic loss resistance of $L_{b2}$.
$L_{b3}$=Inductance of the base element.
$R_{b3}$=Ohmic loss resistance of $L_{b3}$.

FIG. 7

Figure 7A:
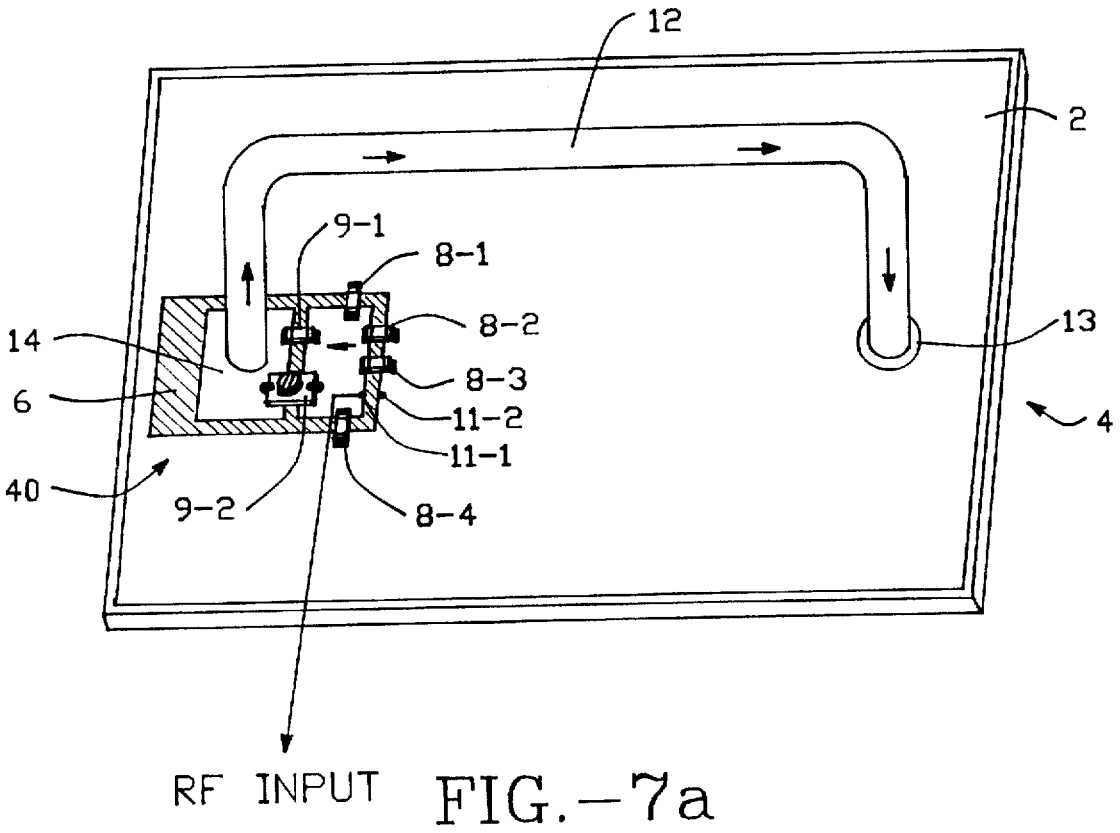
FIG. 7(*a*) shows an isometric view of an alternative embodiment of the loop antenna utilizing a capacitive matching network as an island with the antenna connection at the center near the plane of the conductive loop.
Figure 7B:
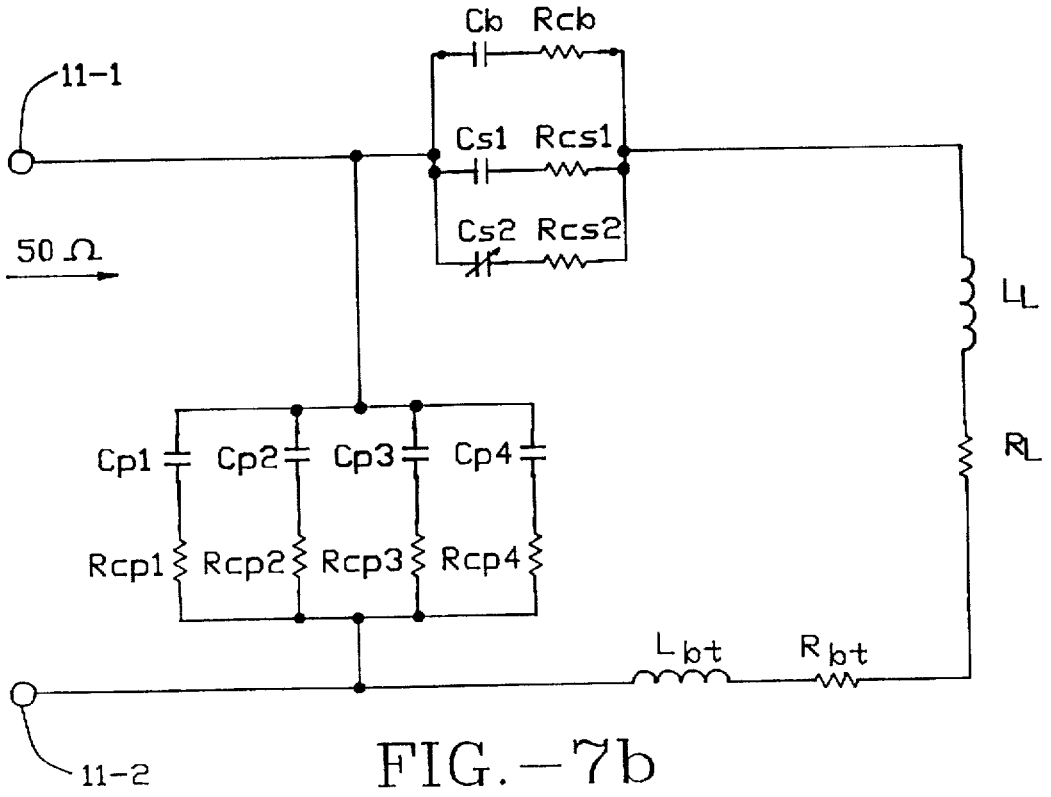

FIG. 7(*a*) shows an isometric view of an alternative embodiment of an antenna 4 utilizing capacitive matching network 40 as an island in base element 2. The FIG. 7 embodiment allows the antenna connector 11, consisting of signal conductor 11-1 and ground conductor 11-2, to be located at the center near the plane of loop element 12 instead of at corner 24 as in FIG. 1. The FIG. 7 embodiment demonstrates the versatility of the capacitive matching network that allows the antenna to have its RF circuit connection through connector 11 anywhere on base element 2 with negligible loss in performance by merely changing the etched pattern of the copper conductive layer on base 5.

Since the FIG. 7(*a*) antenna is structured the same as that in FIG. 1 embodiment except for the placement of connector 11 closer to the plane of loop 12, its equivalent circuit is identical to that of the antenna shown in FIG. 1, as shown in FIG. 7(*b*).

FIG. 8

Figure 8A:
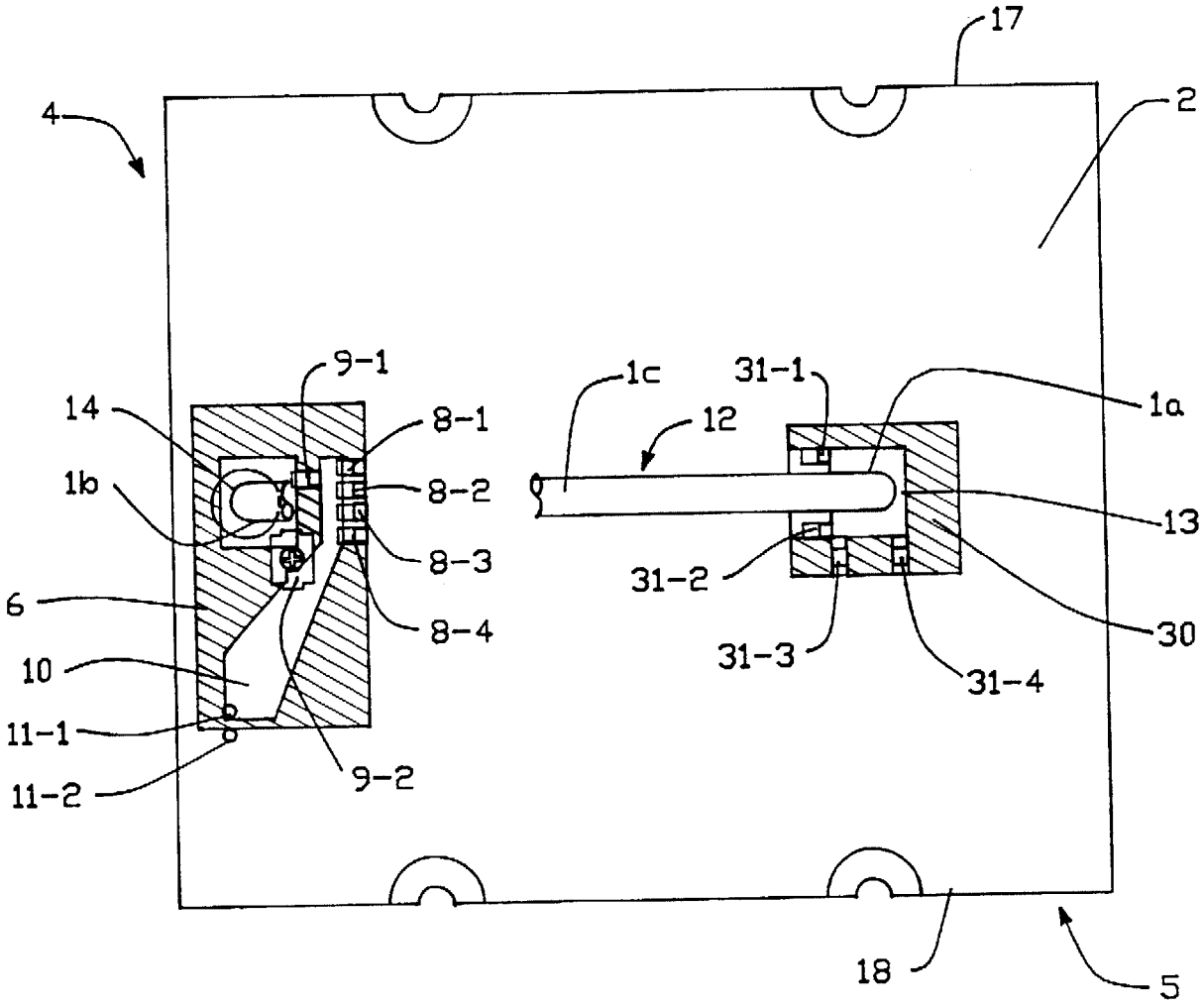
FIG. 8(*a*) shows a top view of a 433 MHz alternate antenna embodiment with capacitors between each of the vertical legs of the conductive loop and the base element.
Figure 8B:
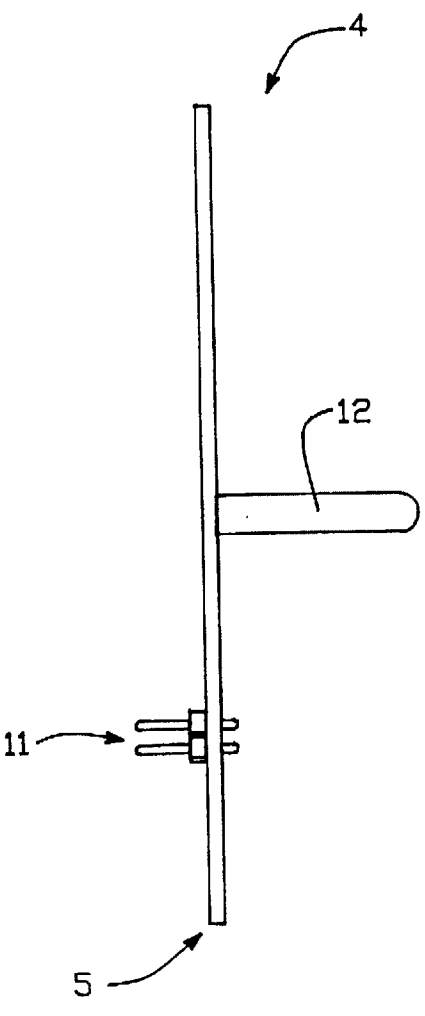
Figure 8C:
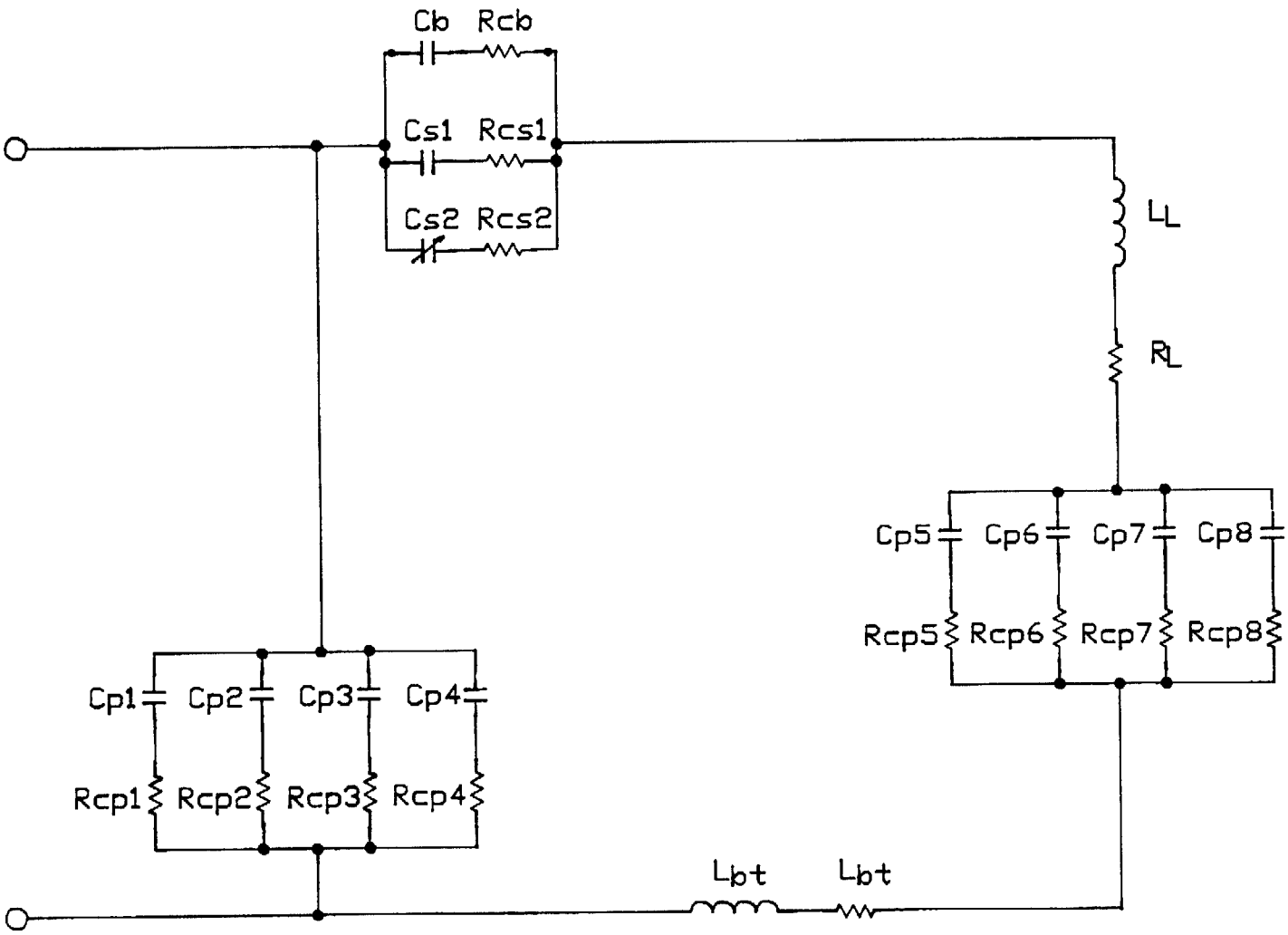
Figure 9A:
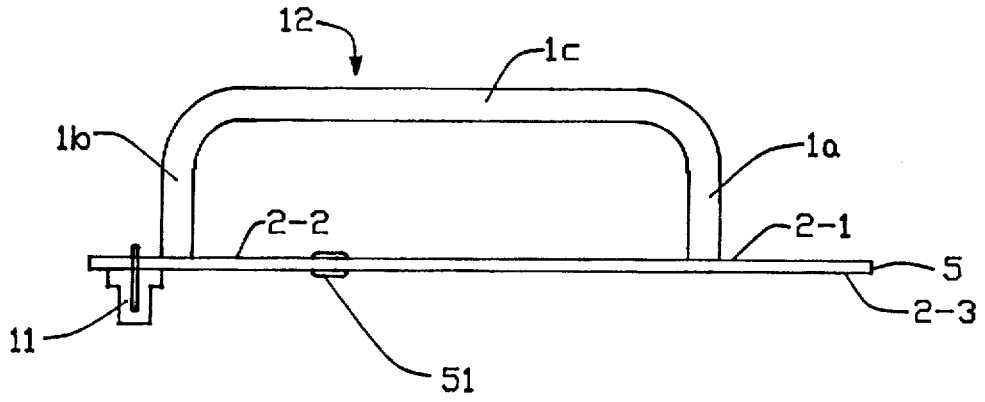
FIG. 9(*a*) shows a side view of an alternative antenna embodiment with a tapped inductor matching network.
Figure 9B:
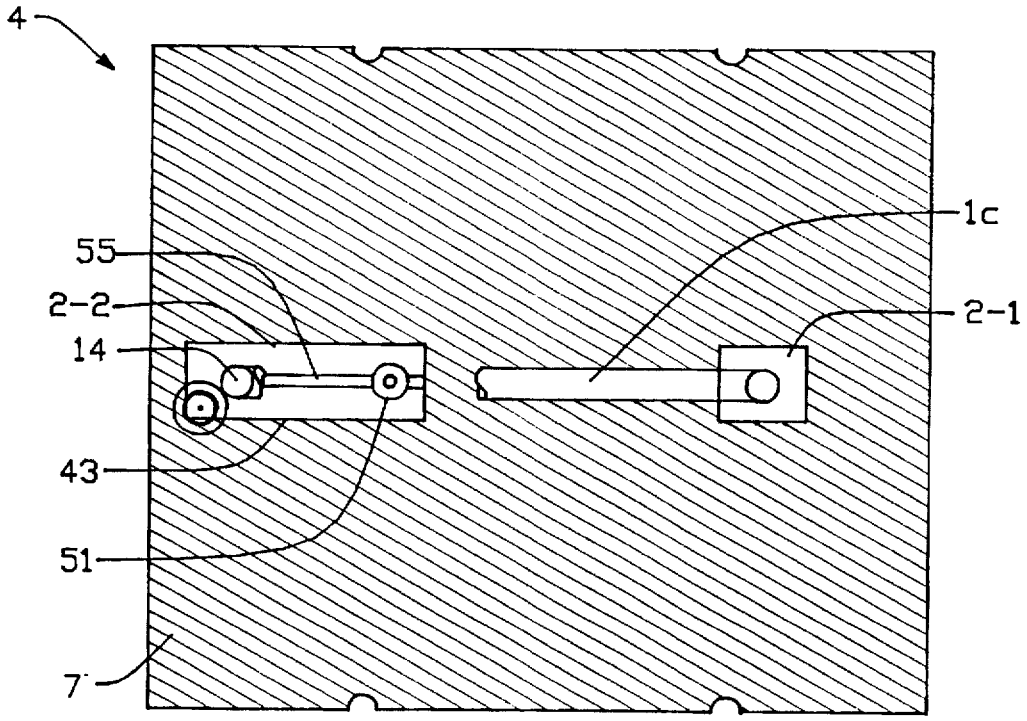
Figure 9C:
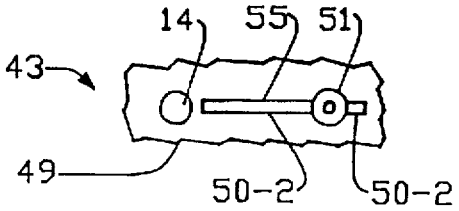
Figure 9D:
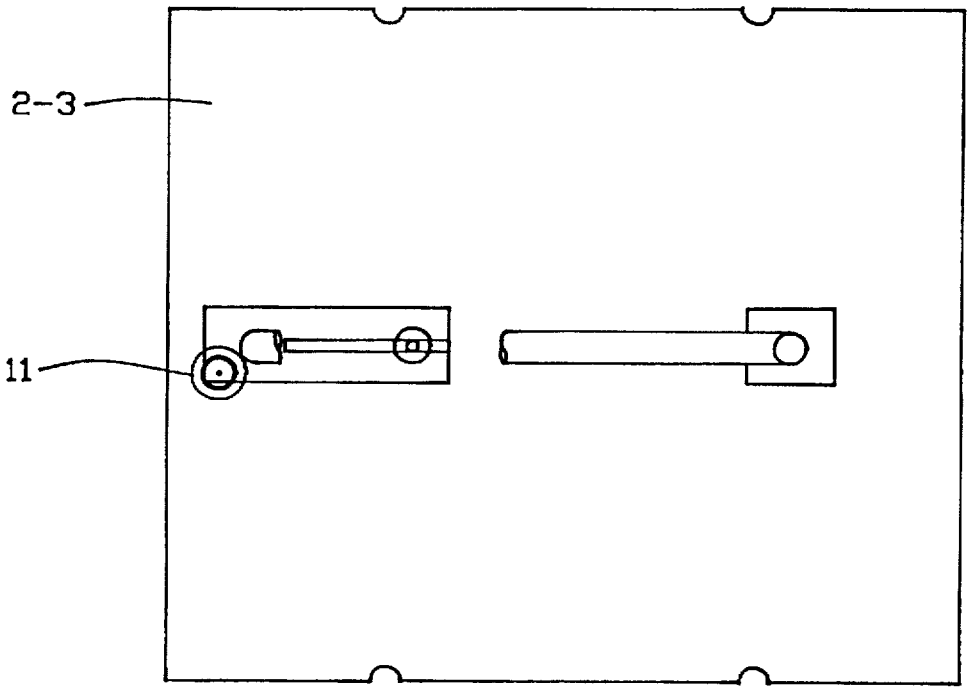
Figure 9E:
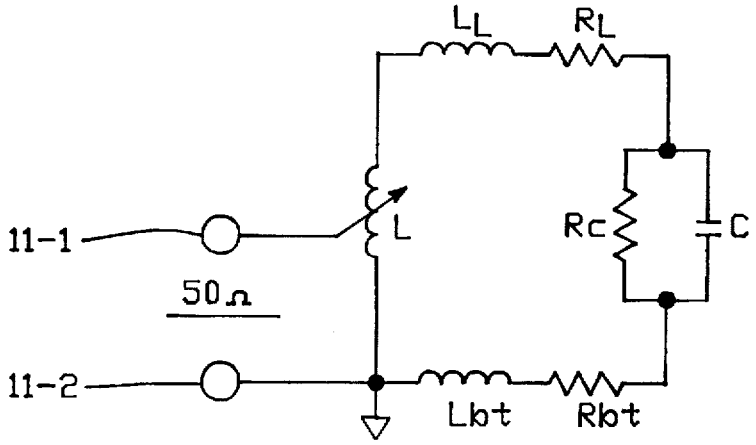

FIG. 8(*a*) and FIG. 8(*b*). FIG. 8(*a*) shows a top view of a 433 MHz alternate embodiment of antenna 4 with capacitors between each of loop element legs 1(*a*) and 1(*b*) and base element 2. Capacitors 8-1, 8-2, 8-3 and 8-4 are positioned on base 5 close to the plane of loop 12 across a portion of window 6. Similarly, series resonant capacitor 9-1 is also placed close to the plane of loop 12. For this reason, the resonant circuit path is short so as to maximize the efficiency, like the path in the embodiment of FIG. 1.

In FIG. 8(*a*), neither loop element 1(*a*) nor loop element 1(*b*) of loop 12 contacts base 2 directly. Loop element 1(*b*) connects to base element 2 via the same matching network 19 as that seen in the FIG. 1 embodiment. Loop element 1(*a*) is connected to conducting pad 13 located in nonconducting window 30. Four additional capacitors 31-1, 31-2, 31-3 and 31-4 ($C_{p7}$, $C_{p8}$, $C_{p9}$ and $C_{p10}$ respectively) are placed across window 30 to connect base element 2 to pad 13. Capacitors 31-1 and 31-2 are located close to the plane of loop 12. With this placement of components, the series resonant current through the legs 1(*a*), 1(*b*), and 1(*c*) of loop 12 connects in a short path through pad 13, capacitors 31-1 and 31-2 to base element 2, through capacitors 8-1, 8-2, 8-3 and 8-4 to the narrow end of strip conductor 10 and through capacitors 9-1 and 9-2 to pad 14 to return to leg 1(*b*). Capacitors 31-3 and 31-4 between pad 13 and base element 2 cross another portion of window 30 in a direction orthogonal to the plane of loop 12. By this arrangement, the current through capacitors 31-3 and 31-4 is directed away from the plane of loop element 12, that is, toward edge 18 of base element 2. The net result of the current being unbalanced toward one side of the plane of conductive loop 12 is an increase the omnidirectional characteristics of antenna 4.

The approximate size of the antenna loop elements in FIG. 8(*a*) for one embodiment at 433 MHz is given below in both physical and electrical dimensions. The wavelength (λ) of a 433 MHz radio frequency signal is 693 mm. Base element 2 measures 99 mm long (0.14λ) by 85 mm wide (0.12λ) and 0.03 mm (0.00004λ) thick, has perpendicular loop elements 1(*a*) and 1(*b*) measuring 19 mm long (0.03λ) and has parallel loop elements measuring 67 mm (0.1λ) long. The antenna loop elements are tubular (circular in cross-section) with a uniform diameter of 4.06 mm (0.006λ) in one embodiment. Typically, base 5 is a conventional printed circuit board material with base element 2, a 0.03 mm copper plate clad to a 1.65 mm dielectric layer 7.

In the FIG. 8 matching circuit, fixed capacitor 9-1 ($C_{s1}$) and variable capacitor 9-2 ($C_{s2}$) connect between strip connector 10 and pad 14 of loop element 1(*b*). Impedance matching parallel capacitors 8-1, 8-2, 8-3, and 8-4 ($C_{p1}$, $C_{p2}$, $C_{p3}$ and $C_{p4}$, respectively) connect between strip connector 10 and base element 2 in the same manner as in the FIG. 1 antenna.

FIG. 8(*b*) shows an end view of the FIG. 8(*a*) antenna.

In the FIG. 8 embodiment, the antenna operates at a higher frequency because the total capacitance formed by the parallel combination of capacitors 31-1, 31-2, 31-3 and 31-4 in series with $C_{st}$ (as defined in FIG. 4) significantly lowers the equivalent series resonant capacitance. It is important that the value of each individual capacitor that contributes to the equivalent series resonant capacitance be as high as possible in order to minimize the stray displacement current flowing through the dielectric base material.

FIG. 8(*c*). The equivalent circuit for the antenna of FIG. 8(*a*), as shown in FIG. 8(*c*), is like that of the antenna of FIG. 1 (shown in FIG. 4(*a*)), except that FIG. 8(*c*) must include the parallel connection of capacitors $C_{p7}$, $C_{p8}$, $C_{p9}$ and $C_{p10}$ in series with $C_{s1}$ and $C_{s2}$.

FIG. 8(*d*) and 8(*e*). The far-field radiation patterns for the embodiment of FIGS. 8(*a*) and 8(*b*) is shown in FIGS. 8(*d*1) and 8(*e*1). FIG. 8(*d*1) shows the radiation pattern in the X–Y plane expressed as $E_\phi(\phi)$ in polar coordinates. $E_\phi$ is the polarization orientation of the electric field strength where $\phi$ is the azimuthal angle and $E_\phi(\phi)$ expresses $E_\phi$ as a function of the azimuthal angle $\phi$. The pattern is virtually omnidirectional, being similar to the radiation pattern of an ideal electrically small loop antenna. The maximum directional gain of the antenna was found to be approximately −3.5 dB with reference to the gain of a dipole antenna at the 433 MHz radiation frequency (dBd). FIG. 8(*d*1) shows the radiation pattern normalized to the maximum directive gain of the antenna. There is a small front-to-back ratio of approximately 1 dB in this pattern.

FIG. 8(*e*1) is the far-field pattern in the Y–Z plane expressed as $E_\phi(\theta)$ in polar coordinates. $E_\phi(\theta)$ is a function of the angle $\theta$, the zenith (elevation) angle. The radiation pattern is shown normalized to the maximum directive gain of the antenna (−3.5 dBd) which occurs in the X–Y plane. FIG. 8(*e*1) is a figure-eight pattern similar to the pattern of an ideal electrically small loop antenna. However, planar base element 2 causes the nulls of the FIG. 8(*e*1) pattern to be somewhat shallower than the nulls of an ideal small loop antenna. Nulls exist at $\theta$=90° and 270° and are approximately 12 to 15 dB below the maximum directive gain of the antenna. There is also a slight front-to-back ratio of 2 dB in this pattern. The relatively larger size of base element 2 results in slightly shallower nulls in comparison to the antenna of FIG. 1. Furthermore, the significantly higher gain is due to the larger electrical dimensions (with respect to wavelength) of this antenna as compared to the antenna of FIG. 1.

FIG. 9

FIG. 9 depicts an alternative matching circuit with conductive loop 12 which inherently is an inductor that includes tapped inductor 49. FIG. 9(*a*) shows a front view of an alternative embodiment of antenna 4, having an inductive matching network 43 as shown in FIG. 9(*b*). Matching network 43 is located on base 5 and functions to match the antenna to a 50-ohm connector 11 in a manner similar to capacitive matching network 19, previously described. Loop 12 includes loop elements 1(*a*), 1(*b*) and 1(*c*). Vertical elements 1(*a*) and 1(*b*) contact base 5 via pads 2-1 and 14, respectively. Base 5 is a printed circuit board consisting of dielectric material 7 and having two top copper conductive pads 2-1 and 2-2 and a bottom copper conductive layer 2-3.

As shown in FIG. 9(*b*), the matched operation is achieved by tuning a tapped inductor 49 in matching network 43 by adjusting the position of an inductor tap 51, a conductor that connects through base 5 as shown. Inductor tap 51 slides along slot 55 that runs down the middle of inductor 49. Inductor 49 includes two parts, conductor 50-1 on one side (shown in FIG. 9(*c*), on the right side) of inductor tap 51 and conductor 50-2 on the other side of inductor tap 51 (shown in FIG. 9(*c*), on the left side). The length of conductor 50-1 relative to the length of conductor 50-2 is controlled by the position of the sliding inductor tap 51. Tapped inductor 49 connects to conductive element 1(*b*) of the loop 12 at pad 14. Similarly, conductive element 1(*a*) at the other end of loop 12 connects to pad 2-1. The inductive coupling of matching network 43 of FIG. 9 allows antenna 4 to be matched with a 50-ohm impedance to the electrical circuit board via connector 11.

FIG. 9(*d*) shows the bottom view of the antenna of FIGS. 9(*a*) and 9(*b*).

FIG. 9(*e*) shows the equivalent circuit of the inductive tuning embodiment of FIGS. 9(*a*) and 9(*b*).

From a manufacturing consideration, it is often difficult to produce inductive components reliably in large quantities. Furthermore, the method of tuning an antenna by adjusting the tapping point of an inductor is inefficient. For low-cost antennas that are easily manufactured using standard components, a capacitive matching circuit with a variable capacitor for tuning is generally the preferred design.

FIG. 10

Figure 10:
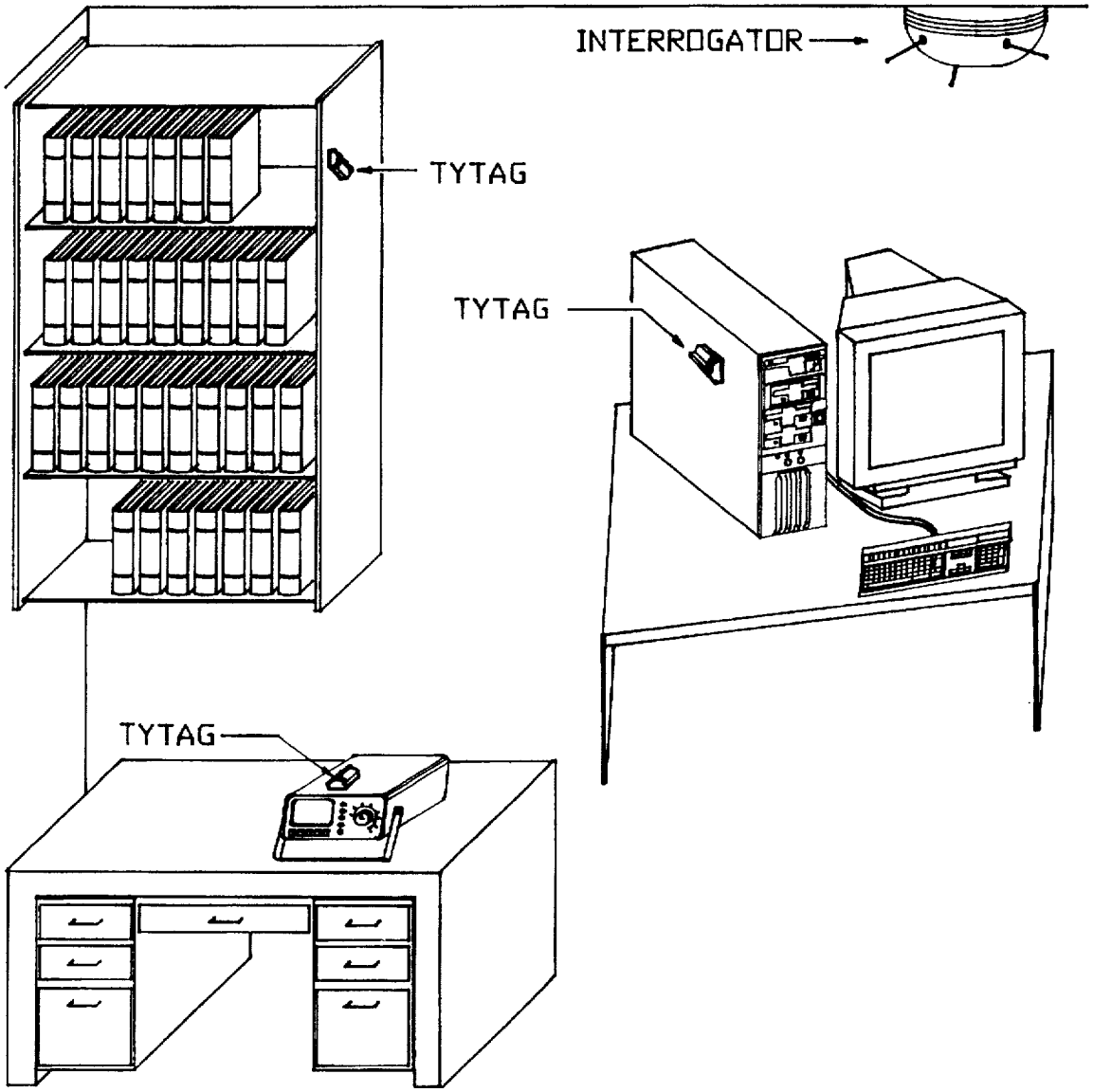
FIG. 10 shows a typical environment with portable communication devices using antennas of the present invention (identified in the figure as Radio Tag).

Typical environments in which antennas in accordance with the present invention (identified as Radio Tag) are used are shown in FIG. 10.

While the invention has been particularly shown and described with reference to preferred embodiments thereof it will be understood by those skilled in the art that various changes in form and details may be made therein without departing from the spirit and scope of the invention.

FURTHER AND OTHER EMBODIMENTS

The various embodiments of the invention include means for controlling the direction of the electric current in said base element to control the antenna directionality. In particular, the windows and capcitors of the base element together with the geometry of the base element are such means. Other electrical components and geometries may also be used within the scope of the present invention.

While the invention has been particularly shown and described with reference to preferred embodiments thereof it will be understood by those skilled in the art that various changes in form and details may be made therein without departing from the spirit and scope of the invention.

We claim:

1. An electrically small loop antenna for connection to an electrical circuit for operation at a radiation frequency, said antenna comprising, a radiation device conducting a resonant current for radiation at the radiation frequency, said radiation device including, a base member having a conductive planar base element extending in a base plane for conducting said resonant current for radiation at the radiation frequency, a conductive loop extending from a first end to a second end for conducting said resonant current for radiation at the radiation frequency, said first end connected to said conductive planar base element at a first location;

a first non-conductive window disposed in said base member at a second location extending between said conductive planar base element and said conductive loop second end;

a matching network for matching the impedance of the radiation device to the impedance of the electrical circuit, said matching network extending within said first window and connecting the second end of the conductive loop to said conductive planar base element at a third location to form a resonant circuit loop having a high Q, said resonant circuit loop including said conductive planar base element and said conductive loop whereby said resonant current is conducted through the base element and through the conductive loop; and connector means having first and second conductors for connecting to the electrical circuit, one of said conductors connected directly to said base element and the other of said conductors connected to the matching network whereby electrical current is conducted between the electrical circuit and the radiation device.

2. The antenna of claim 1 wherein said planar base element is formed as a conductive sheet.

3. The antenna of claim 1 wherein said planar base element is formed as a conductive metal cladding on a dielectric material.

4. The antenna of claim 1 wherein said conductive loop lies in a loop plane substantially perpendicular to said base plane.

5. The antenna of claim 1 wherein said conductive loop lies in a loop plane substantially perpendicular to said base plane and wherein a portion of the resonant current in said base element is distributed outside said loop plane.

6. The antenna of claim 1 wherein said conductive loop lies in a loop plane substantially perpendicular to said base plane, wherein a portion of the resonant current in said base element is distributed outside said loop plane, and wherein a substantially greater portion of the resonant current in said base element is located on one side of said loop plane whereby the antenna radiation pattern tends to be omnidirectional.

7. The antenna of claim 1 wherein said matching network includes a capacitor extending across said first window and connected between said base element and the loop element for conducting said current resonant.

8. The antenna of claim 1 wherein said base member further includes a second non-conductive window, wherein said matching network includes a first capacitor extending within said first window and connected between said conductive planar base element and the second end of the loop element, wherein a second capacitor extends within said second window and is connected between said conductive planar base element and the first end of the loop element whereby the first and second capacitors are connected in series resonance with the conductive planar base element and the loop element for conducting said radiation current.

9. The antenna of claim 8 wherein a third capacitor extends within said second window and is connected between said first end of the loop element and the conductive planar base element, said third capacitor being oriented orthogonal to said second capacitor.

10. The antenna of claim 1 wherein said conductive loop lies in a loop plane substantially perpendicular to said base plane, wherein said matching network is formed with a plurality of capacitors extending across said first window and connected between said base element and said loop element at a plurality of different capacitor locations distributed in the base plane whereby the resonant current in said base element tends to be distributed in said base plane.

11. The antenna of claim 10 wherein said capacitors extending across said first window are positioned in close proximity to said loop plane whereby the length of the conduction path for the resonant current in the radiation device and through the capacitors is minimized.

12. The antenna of claim 10 wherein said capacitors are constructed with high-loss material.

13. The antenna of claim 10 wherein said capacitors are constructed with low-loss material.

14. The antenna of claim 1 wherein said conductive loop includes first and second loop elements substantially perpendicular to said base plane and a third loop element substantially parallel to said base plane.

15. The antenna of claim 14 wherein said first, second and third loop elements are circular in cross-section and have a surface area small compared to the surface area of said base element in the base plane.

16. The antenna of claim 1 wherein said conductive loop includes first and second loop elements substantially perpendicular to said base plane and a third loop element substantially parallel to said base plane and where each of said first, second, third, and base elements each have lengths that are less than one tenth the wavelength of the radiation frequency.

17. The antenna of claim 1 wherein said conductive loop includes first and second loop elements substantially perpendicular to said base plane and a third loop element substantially parallel to said base plane and where said first and second loop elements have a height above said base plane that tends to optimize the antenna performance.

18. The antenna of claim 1 wherein said conductive loop includes first and second loop elements substantially perpendicular to said base plane and a third loop element substantially parallel to said base plane, said base element having a base element length extending in the loop plane and having a base element width extending normal to the base element length, and where said first and second loop elements have a loop element height above said base plane less than two times the base element width so as to optimize the antenna performance.

19. The antenna of claim 18 wherein said loop element height is approximately one-half the base element width.

20. The antenna of claim 1 wherein said conductive loop includes first and second loop elements substantially perpendicular to said base plane and a third loop element substantially parallel to said base plane and where said first, second and third loop elements are formed of conductors circular in cross-section having surface areas small relative to the surface area of the base element in the base plane.

21. The antenna of claim 1 wherein said matching network is formed in said first window, said matching network including, a strip connector lying between a portion of said base element and the second end of the conductive loop, series resonant capacitance means connecting said strip connector to said second end, parallel matching capacitance means connecting said strip connector to said base element.

22. The antenna of claim 21 wherein said series resonant capacitance means includes first and second capacitors connected in parallel.

23. The antenna of claim 21 wherein said series resonant capacitance means include a tunable capacitor and a fixed capacitor in parallel with said tunable capacitor.

24. The antenna of claim 23 wherein said tunable capacitor has a capacitance C and has a rotating tuning element for adjusting the capacitance C where $\psi$ is the angle of rotation of the rotating tuning element and $dC/d\psi$ is the rate of change of the capacitance, C, of the tunable capacitor as a function of $\psi$, said tunable capacitor and said fixed capacitor having values to establish the tuning characteristics of the matched network such that a large change in $\psi$ due to a large rotation of the tuning element results in a small change of C.

25. The antenna of claim 21 wherein said parallel matching capacitance means includes a plurality of capacitors connected in parallel.

26. The antenna of claim 1 wherein said radiation device is for transmitting at said radiation frequency and said antenna functions to emit electromagnetic waves.

27. The antenna of claim 1 wherein said radiation device is for receiving at said radiation frequency and said antenna functions to intercept electromagnetic waves.

28. The antenna of claim 1 wherein said radiation device is for transmitting and receiving at said radiation frequency and said antenna functions to both emit and intercept electromagnetic waves.

29. An electrically small loop antenna for operation at a radiation frequency, said antenna comprising, a radiation device conducting a resonant current for radiation at the radiation frequency, said radiation device including, a base member having a conductive planar base element extending in a base plane for conducting said resonant current for radiation at the radiation frequency, said base member having a non-conductive window for controlling the direction of the resonant current in the planar base element, a conductive loop extending from a first end to a second end for conducting said resonant current for radiation at the radiation frequency, said first end of the conductive loop connected to said base element at a first location and said second end of the conductive loop connected to said base member at a second location spaced from said first location, said conductive loop lying in a loop plane substantially perpendicular to said base plane, and wherein said window is configured between said conductive loop second end and said conductive planar base element for controlling the direction of the resonant current in said base element away from said loop plane to control the antenna directionality; and a matching network for matching the impedance of the radiation device to the impedance of the electrical circuit, said matching network extending within said window and connecting the second end of the conductive loop to the conductive planar base element at the second location to form a resonant circuit loop, said resonant circuit loop including said conductive planar base element, said conductive loop and said matching network, whereby said resonant current is conducted through the base element, the conductive loop and the matching network.

30. The antenna of claim 29 wherein said matching network includes an inductor extending across said window and connected between said base element and the loop element for conducting said resonant current.

31. The antenna of claim 30, wherein the inductor functions as a tapped transformer.

32. The antenna of claim 31 wherein said transformer includes a strip conductor and a sliding tap for making a tap connection to said strip conductor whereby the impedance transformation ratio of the transformer is changeable for tuning the antenna.

33. A communication transceiver comprising, an electrical circuit mounted on a circuit board for operation at a radiation frequency, an electrically small loop antenna including, a radiation device including, a base member having a conductive planar base element extending in a base plane, a conductive loop extending from a first end to a second end, said first end of the conductive loop connected to said conductive planar base element at a first location, a first non conductive window disposed in said base member at a second location and extending between said conductive planar base element and said conductive loop second end, a matching network for matching the impedance of the radiation device to the impedance of the electrical circuit, said matching network extending within said first non conductive window and connecting the second end of the conductive loop to said conductive planar base element at a third location whereby a radiation current is conducted through the base element and the conductive loop, connector means having first and second conductors for connecting to the electrical circuit, one of said conductors connected to said base element and the other of said conductors connected to the matching network whereby a connector current is conducted between the antenna and the electrical circuit, battery means for powering the electrical circuit, a housing including, means for engaging and locating the circuit board having the electrical circuit at a first level, means for engaging and locating the base element of the radiation device at a second level parallel to and offset from the first level whereby the base element is positioned in a plane offset from the electrical circuit to isolate the electrical circuit from the conductive loop of the radiation device.

34. Communication device embodying the antenna of claim 33 wherein said base member is formed as a conductive sheet on a high-loss dielectric material.

35. The antenna of claim 33 wherein said base member is formed as a conductive sheet on a low-loss dielectric material.

36. The antenna of claim 33 wherein said conductive loop lies in a loop plane substantially perpendicular to said base plane.

37. The antenna of claim 33 wherein said conductive loop lies in a loop plane substantially perpendicular to said base plane and wherein a portion of the radiation current in said base element is distributed outside said loop plane.

38. The antenna of claim 33 wherein said conductive loop lies in a loop plane substantially perpendicular to said base plane, wherein a portion of the resonant current in said base element is distributed outside said loop plane, and wherein a substantially greater portion of the radiation current in said base element is located on one side of said loop plane whereby the antenna radiation pattern tends to be omnidirectional.

39. The antenna of claim 33 wherein said matching network includes a capacitor extending within said first window connected to said base element.

40. The antenna of claim 33 wherein said base member further includes a second nonconductive window, wherein said matching network includes a first capacitor extending within said first window and is connected between said conductive planar base element and said second end of the loop element, wherein a second capacitor is connected between said conductive planar base element and the first end of the loop element whereby the first and second capacitors are connected in series.

41. The antenna of claim 40 wherein a third capacitor extends within said second window and is connected between said first end of the loop element and the conductive planar base element, said third capacitor being oriented orthogonal to said second capacitor.

42. The antenna of claim 33 wherein said conductive loop lies in a loop plane substantially perpendicular to said base plane and wherein said antenna includes means for controlling the direction of the radiation current in said base element to control the antenna directionality.

43. The antenna of claim 33 wherein said base plane includes a non-conductive window and wherein said matching network includes an inductor in said window connected to said base element.

44. The antenna of claim 43 wherein the inductor is a tapped transformer.

45. The antenna of claim 44 wherein said transformer includes a strip conductor and a sliding tap for making a tap connection to said strip conductor whereby the impedance transformation ratio of the transformer is changeable for tuning the antenna.

46. The antenna of claim 33 wherein said conductive loop lies in a loop plane substantially perpendicular to said base plane, wherein said matching network is formed with a plurality of capacitors located in said window and connected to said base element at a plurality of different capacitor locations distributed in the base plane whereby the radiation current in said base element tends to be distributed in said base plane.

47. The antenna of claim 46 wherein said capacitors located in said window are positioned in close proximity to said loop plane whereby the length of the conduction path for the radiation current in the radiation device is minimized.

48. The antenna of claim 46 wherein said capacitors are constructed with high-loss material.

49. The antenna of claim 46 wherein said capacitors are constructed with low-loss material.

50. The antenna of claim 33 wherein said conductive loop includes first and second loop elements substantially perpendicular to said base plane and a third loop element substantially parallel to said base plane.

51. The antenna of claim 50 wherein said first, second and third loop elements are circular in cross-section, having a surface area small compared to the surface area of said base element in the base plane.

52. The antenna of claim 33 wherein said conductive loop includes first and second loop elements substantially perpendicular to said base plane and a third loop element substantially parallel to said base plane and where each of said first, second, third, and base elements have lengths that are less than one tenth the wavelength of the radiation frequency.

53. The antenna of claim 33 wherein said conductive loop includes first and second loop elements substantially perpendicular to said base plane and a third loop element substantially parallel to said base plane and where said first and second loop elements have a height above said base plane that tends to optimize the antenna performance.

54. The antenna of claim 33 wherein said conductive loop includes first and second loop elements substantially perpendicular to said base plane and a third loop element substantially parallel to said base plane, said base element having a base element length extending in the loop plane and having a base element width extending normal to the base element length, and where said first and second loop elements have a loop element height above said base plane less than two times the base element width so as to optimize the antenna performance.

55. The antenna of claim 54 wherein said loop element height is approximately one-half the base element width.

56. The antenna of claim 33 wherein said conductive loop includes first and second loop elements substantially perpendicular to said base plane and a third loop element substantially parallel to said base plane and where said first, second and third loop elements are circular in cross-section having surface areas small relative to the surface area of the base element in the base plane.

57. The antenna of claim 33, said matching network including, a strip connector lying between a portion of said base element and the second end of the conductive loop, series resonant capacitance means connecting said strip connector to said second end, parallel matching capacitance means connecting said strip connector to said base element.

58. The antenna of claim 57 wherein said series resonant capacitance means includes first and second capacitors connected in parallel.

59. The antenna of claim 57 wherein said series resonant capacitors include a tunable capacitor and a fixed capacitor in parallel with said tunable capacitor.

60. The antenna of claim 59 wherein said tunable capacitor has a capacitance C and has a rotating tuning element for adjusting the capacitance C where $\psi$ is the angle of rotation of the rotating tuning element and $dC/d\psi$ is the rate of change of the capacitance, C, of the tunable capacitor as a function of $\psi$, said tunable capacitor and said fixed capacitor having values to establish the tuning characteristics of the matched network such that large changes in $\psi$ from large rotations of the tuning element result in small changes of C.

61. The antenna of claim 57 wherein said parallel matching capacitance means includes a plurality of capacitors connected in parallel.

62. The antenna of claim 33 wherein said radiation device is for transmitting at said radiation frequency.

63. The antenna of claim 33 wherein said radiation device is for receiving at said radiation frequency.

64. The antenna of claim 33 wherein said radiation device is for transmitting and receiving at said radiation frequency.

65. An electrically small loop antenna for connection to an electrical circuit for operation at a radiation frequency comprising, a radiator including, a conductive loop having a height and extending in a loop plane from a first end to a second end, a base member having a conductive planar base element free of electrical components extending in a base plane substantially perpendicular to said loop plane, said conductive planar base element forming a non-conductive window, said window extending in a direction perpendicular to said loop plane, said first end of the conductive loop connected to said conductive planar base element at a location removed from said window, and said second end of the conductive loop connected to said base member at a location within and encompassed by said window;

connector means having first and second conductors for connecting the antenna to the electrical circuit, one of said conductors connected to said base element; and a matching network extending within said window and connecting the second end of the conductive loop to the conductive planar base element and to the other one of said conductors whereby radiation current is conducted through the base element and the conductive loop and whereby the antenna is matched to the electrical circuit.

66. The antenna of claim 65 wherein said matching network is formed across said window, said matching network including, a strip connector lying between a portion of said base element and the second end of the conductive loop, series resonant capacitors connected in parallel connecting said strip connector to said second end, parallel matching capacitors connected in parallel connecting said strip connector to said base element.

67. An electrically small loop antenna for connection to an electrical circuit for operation at a radiation frequency, said antenna comprising, a radiation device conducting a resonant current for radiation at the radiation frequency, said radiation device including, a base member having a conductive planar base element extending in a base plane for conducting said resonant current for radiation at the radiation frequency, said base member having a non conductive window, a conductive loop extending from a first end to a second end for conducting said resonant current for radiation at the radiation frequency, said first end connected to said conductive planar base element at a first location and said second end connected to said base member at a second location spaced from said first location to enable said resonant current to conduct through the conductive planar base element and the conductive loop;

a matching network extending within said window for matching the impedance of the radiation device to the impedance of the electrical circuit, said matching network connecting the second end of the conductive loop to the conductive planar base element at the second location to form a resonant circuit loop having a Q greater than 10, said resonant circuit loop including said conductive planar base element and said conductive loop whereby said resonant current is conducted through the base element and through the conductive loop; and connector means having first and second conductors for connecting to the electrical circuit, one of said conductors connected directly to said base element and the other of said conductors connected to the matching network whereby electrical current is conducted between the electrical circuit and the radiation device.

68. An electrically small loop antenna for operation at a radiation frequency, said antenna comprising, a radiation device conducting a resonant current for radiation at the radiation frequency, said radiation device including, a base member having a conductive planar base element extending in a base plane for conducting said resonant current for radiation at the radiation frequency, said base member having a first and a second non-conductive window for controlling the direction of the resonant current in the base element, a conductive loop having a height and extending from a first end to a second end for conducting said resonant current for radiation at the radiation frequency, said first end of the conductive loop connected to said base member at a first location and said second end of the conductive loop connected to said base member at a second location spaced from said first location, said conductive loop lying in a loop plane substantially perpendicular to said base plane, and wherein said second window is configured about said conductive loop second end and said first window is configured about said conductive loop first end to extend a substantial amount of the resonant current away from said loop plane, wherein a capacitor extends within said first window between said loop element first end and said conductive planar base element, said first and second windows controlling the direction of the resonant current in said base element away from said loop plane and thereby determine the antenna directionality; and a matching network for matching the impedance of the radiation device to the impedance of the electrical circuit, said matching network extending across said second non conductive window and connecting the second end of the conductive loop to the conductive planar base element at the second location to form a resonant circuit loop, said resonant circuit loop including said conductive planar base element, said conductive loop, said capacitor and said matching network.

* * * * *